US012638217B2

(12) United States Patent
Spray et al.

(10) Patent No.: US 12,638,217 B2
(45) Date of Patent: May 26, 2026

(54) GEOTHERMAL WELL METHOD AND SYSTEM

(71) Applicant: Dynamic Tubular Systems, LLC, Houston, TX (US)

(72) Inventors: Jeffery Spray, Houston, TX (US); William Ott, Houston, TX (US)

(73) Assignee: Dynamic Tubular Systems, LLC, Houston, TX (US)

( * ) Notice: Subject to any disclaimer, the term of this patent is extended or adjusted under 35 U.S.C. 154(b) by 0 days.

(21) Appl. No.: 18/562,304

(22) PCT Filed: Jun. 14, 2022

(86) PCT No.: PCT/US2022/033401
§ 371 (c)(1),
(2) Date: Apr. 15, 2024

(87) PCT Pub. No.: WO2022/266077
PCT Pub. Date: Dec. 22, 2022

(65) Prior Publication Data

US 2024/0328678 A1 Oct. 3, 2024

Related U.S. Application Data

(60) Provisional application No. 63/360,918, filed on Nov. 12, 2021, provisional application No. 63/259,020, filed on Jun. 15, 2021.

(51) Int. Cl.
*F24T 10/20* (2018.01)
*F24T 10/00* (2018.01)

(52) U.S. Cl.
CPC ..... *F24T 10/20* (2018.05); *F24T 2010/53* (2018.05)

(58) Field of Classification Search
CPC ..... E21B 43/26; F24T 10/20; F24T 2010/53
See application file for complete search history.

(56) References Cited

U.S. PATENT DOCUMENTS

| | | | |
|---|---|---|---|
| 2,904,115 | A | 9/1959 | Turner |
| 3,297,088 | A | 1/1967 | Huitt et al. |
| 5,159,979 | A | 11/1992 | Jennings, Jr. |
| 5,261,487 | A | 11/1993 | McLeod et al. |
| 6,817,633 | B2 | 11/2004 | Brill et al. |

(Continued)

FOREIGN PATENT DOCUMENTS

| | | | | |
|---|---|---|---|---|
| CN | 105863569 A | * | 8/2016 | |
| CN | 107989589 A | * | 5/2018 | ..... E21B 33/122 |

(Continued)

OTHER PUBLICATIONS

Matos, PCT/US2022/033401 Written Opinion of the International Searching Authority, Nov. 2, 2022.

(Continued)

*Primary Examiner* — Matthew R Buck

(57) ABSTRACT

In various aspects of the invention, the following are provided: a process of creating a geothermal well in high-temperature, impermeable rock is provided; a geothermal well in high-temperature, impermeable rock; a process of operating a geothermal well; a packer; and a process for creating a seal in an annulus between a cylinder and a borehole located in a target zone in high-temperature, impermeable rock.

17 Claims, 20 Drawing Sheets

(56) References Cited

U.S. PATENT DOCUMENTS

| | | | | |
|---|---|---|---|---|
| 8,839,865 | B2 | 9/2014 | Willberg et al. | |
| 2009/0065083 | A1 | 3/2009 | Mei | |
| 2010/0024481 | A1 | 2/2010 | Rothstein | |
| 2010/0319347 | A1 | 12/2010 | Viernickel | |
| 2017/0101846 | A1 | 4/2017 | Vasques et al. | |
| 2017/0241248 | A1 | 8/2017 | Barak et al. | |
| 2019/0128068 | A1* | 5/2019 | Danko | E21B 47/022 |
| 2019/0128427 | A1 | 5/2019 | Vanderford et al. | |
| 2020/0165909 | A1 | 5/2020 | Cook | |
| 2020/0191444 | A1 | 6/2020 | Nevison et al. | |
| 2021/0025623 | A1* | 1/2021 | Holtzman | F24T 10/17 |

FOREIGN PATENT DOCUMENTS

| | | | | | |
|---|---|---|---|---|---|
| CN | 107989589 | U | | 5/2018 | |
| CN | 110131781 | A | * | 8/2019 | F24D 15/04 |
| CN | 110131782 | A | * | 8/2019 | F24D 15/04 |
| CN | 110714746 | A | * | 1/2020 | E21B 43/26 |
| CN | 111550227 | A | * | 8/2020 | |
| CN | 212428774 | U | | 1/2021 | |
| CN | 112412414 | A | | 2/2021 | |

OTHER PUBLICATIONS

Author Unknown, Communication pursuant to Rules 70(2) and 70a(2) EPC Notifying Applicant of Invitation to Indicate Wish to Continue EPO Application, Unpublished, Feb. 20, 2025, 1 page.

Author Unknown, EPO Corresponding App. 22825654.1 Transmittal Letter of Extended European Search Report Pursuant to Rule 62 EPC and attachments as noted in transmittal, Feb. 3, 2025, 12 pages, Unpublished.

Author Unknown, EPO_Corr_App_No. 22825654.1_Communication pursuant to R. 161 and 162 & Attachments as Noted on p. 1, Unpublished, Jan. 23, 2025, 16 pages.

Elharby, Substantive Examination Report, May 29, 2025,6 pages, Saudi Authority for Intellectual Property, Saudi Arabia.

Mak, Xiao Yin, EPO Corresponding App. No. 22825654.1, Amended Claims Provided in Response to R161, Unpublished, Jul. 23, 2024, 8 pages.

Mak, Xiao Yin, Response to EPO R161 Communication in Corresponding EPO App. 22825654.1, Unpublished, Jul. 23, 2024, 3 Pages.

Mcclure et al., An Investigation of Stimulation Mechanisms in Enhanced Geothermal Systems, International Journal of Rock Mechanics & Mining Sciences, 2014, pp. 142-260, vol. 72, Elsevier, www.elsevier.com/locate/ijrmms.

Steiner, Katrin, Transmittal of Filing Overview in Response to Feb. 20, 2025 EPO Office Action in Corresponding EPO App. 22825654.1, Unpublished, Aug. 8, 2025, 1 Page.

Steiner, Katrin, Untitled Document of EPO Corresponding. App. No. 22825654.1, Amended Claims Annotated as Filed EPO, Jul. 23, 2024, 6 Pages.

Steinr, Katrin, Response to the Communication under Rules 70(2) and 70a(2) of Feb. 20, 2025 in Corresponding EPO App. 22825654.1, Unpublished, 6 pages.

Abstract (English Translation) filled with response to 1st Saudi Office Action.

Abstract filled with response to 1st Saudi Office Action.

Claims (English Translation) filed with response to 1st Saudi Office Action.

Claims filed with response to 1st Saudi Office Action.

Description (English Translation) filed with response to 1st Saudi Office Action.

Description filed with response to 1st Saudi Office Action.

Response (English Translation) to Saudi 1st Office Action.

Response to Saudi 1st Office Action.

* cited by examiner

GEOTHERMAL WELL METHOD AND SYSTEM

RELATED APPLICATIONS

This application claims priority to U.S. Provisional Application Nos. 63/259,020, filed Jun. 15, 2021; 63/360,918, filed on Nov. 12, 2021.

BACKGROUND

As is well known, the potential of power generating geothermal resources is immense. It is not merely a promising clean energy source, it can be all energy globally, that is delivered by electric grid. Geothermal currently accounts for approximately 0.2% total energy worldwide. Several limitations and difficulties with the resource contribute to geothermal's nearly non-existent status.

Three types of traditional power generating forms of geothermal are practiced commercially or have continued for decades as developmental research: hydrothermal, enhanced geothermal systems (EGS), and closed-loop geothermal, often referred to as AGS, or advanced geothermal systems. These methods have evolved chronologically as problems from the original source, hydrothermal, led to its first promising successor, which only led to a new set of problems.

Hydrothermal energy refers to the extraction of steam or heated water from naturally occurring sources. Requirements for hydrothermal viability generally include a substantial heat source, a relatively clean water source, and geologic permeability adequate to conduct very high quantities of the heated fluids into a well. Limitations against hydrothermal's market presence begin with its rarity, where only an estimated 1.5% of the earth's surface is considered potentially underlain by the resource. The prospective geographic areas are extensively studied geologically and geophysically prior to exploratory drilling. Still, only one-in-ten drilled wellbores find economic resource.

Furthermore, hydrothermal resources are often found in volcanic environments because their formation also creates the permeability component required of the resource. Such environments are also associated with having excessively highly permeable and or unstable formations present in overlying geologic formations that are not geothermally producible. During drilling, such uncontrolled environments cause severe instances of costly and time-consuming lost circulation of drilling fluids, stuck or lost drilling assemblies, and excessive well construction costs due to requirements for multiple installed casing strings. These and related drilling challenges account for drilling and related activities often consuming one-half of the overall investment to discover, develop, and produce geothermal energy, twice the amount necessary for oil and gas, for example.

Still, the massive energy potential exists, and improvements or alternatives to hydrothermal extraction were commenced in decades past. As a multiple-well system (usually two wells with separate injection and recovery wells that communicate through common reservoirs), so-called "enhanced geothermal systems" ("EGS") has promised ubiquity and unlimited "engineered steam" to result from circulating foreign water directly across vast areas of high temperature rock that has been enhanced, i.e., its natural permeability stimulated by hydraulic fracturing methods. EGS is not a traditional "hydrothermal" process, because water is pumped into dry hot rock from the surface. In hydrothermal, the water is already present in the ground.

By use of complex, multiple-well systems, drilling costs are very high. Further, in efforts to maximize available geologic heat and other mentioned conditions, EGS practitioners often drill the same difficult geology and encounter the same problems as their hydrothermal counterparts. Additionally, EGS practitioners resorted to directional drilling, where well trajectories could more reliably pierce a fracture's broad surface area. However, an inherent problem exists concerning overall well length, drilling equipment capabilities, and reachable depth and heat.

Once installed, EGS suffers wide ranging operational issues. First, the creation or exploitation of uncontrolled fracture systems causes potentially massive water losses, an issue costly in terms of energy loss and water expense. Second, hydraulic stimulation and water loss in upper strata commonly cause unwanted seismicity damage in communities. Finally, the configuration of two wells perpendicularly piercing a thin planar fractured reservoir leads to hydraulic short circuiting during production, where the heat carrying fluids too rapidly are passed across limited amounts of the reservoir surface. The result is low heat transfer with efficiency ranging 6% to 10%, and premature cooling of the rock-short-circuit area.

After decades of EGS research, developers have become more focused on less complex "closed loops," where a production tubular assembly is inserted to recover fluids passed through the annular space between the tubing and the well. When placed in above average thermal gradient conditions, the results from such basic arrangements reveal low energy production of generally 3.5 MW to 5 MW, even from wells with depths exceeding 5 km. High drilling cost renders the method largely uneconomic, except when placed in very rare, exceptional thermal environments where heat is abundant nearer to the earth's surface. The problem is that too few such locations exist.

Finally, practitioners more recently emphasize installation of extreme depth wells of 10 miles deep and more towards obtaining supercritical fluid states. Although also under development for decades, the drilling methods provide no viable means of reservoir creation. Such proposals additionally assume creation of brittle, vitrified well linings that face challenges in dealing with borehole stresses and movement.

A long-felt, but unsolved need exists gaining access to geothermal temperature that can result in economic electricity generation and delivery, which would address substantial portions pollution, climate change, many other environmental and public health issues.

U.S. Pat. No. 7,144,511 relates a seawater desalination system comprising: a first stage pump configured to draw, pressurize, and pump seawater feed of a predetermined salinity at a pressure about 400 psi and about 600 psi; a first stage high performance nanofiltration membrane configured to receive the pressurize seawater feed from the first stage pump and to produce a first reteninte and first permeate; a second stage pump configured to draw, pressurize, and pump the first permeate at a pressure between about 200 psi and shout 300 psi; and a second stage high performance nanofiltration membrane configured to receive the pressurized first permeate from the second stage pump and to produce from the first permeate water containing no more than 1,000 mg/l total dissolved solids. EP2822674 discloses a process for recovering brine and for removing sulfate impurity from a brine stream in a nanofiltration system, the brine stream comprising an aqueous solution of NaCl, the system comprising a nanofiltration module, the module comprising a nanofiltration membrane for rejecting sulfate, an inlet for a feed stream, an outlet for a permeate stream which has permeated through the membrane, and an outlet for a pass stream which has not permeated through the membrane, the process comprising: introducing a dilution stream upstream of the feed stream inlet of the module, thereby diluting the feed stream at the feed inlet of the module and increasing the amount of NaCl and water im the permeate stream at the permeate outlet of the module without substantially diluting the concentration of sulfate in the gass stream at the pass outlet of the module.

SUMMARY OF EXAMPLE EMBODIMENTS

One embodiment of the invention provides a process of creating a geothermal well in high temperature impermeable rock, the process comprising: sinking a borehole with a generally-vertical trajectory into the high-temperature, impermeable rock; creating a fluid-conducive fracture in the formation, substantially-laterally from an axis of the borehole, as a target zone in a geologic formation of interest for geothermal energy production, wherein said creating causes the fluid-conductive fracture to have a substantially-vertical dimension that is larger than a substantially-horizontal width dimension and a substantially horizontal length dimension extending substantially-radially from the axis, wherein the substantially-horizontal length dimension is longer than the horizontal width dimension; installing a flow-resistant barrier substantially laterally from the borehole, wherein the barrier is positioned to divert fluid under pressure on a first side of the barrier in the target zone to flow away from the borehole, around the barrier, and into the target zone on a second side of the barrier.

Another aspect of the invention provides that the said installing a flow-resistant barrier comprises installing a substantially impermeable fluid barrier.

Another aspect of the invention provides that the said sinking a borehole comprises casing the borehole at the target zone of interest and perforating the casing to access the geologic formation of interest.

Another aspect of the invention provides that the said creating a fluid-conductive facture comprises fracturing the high, impermeable rock in the target zone.

Another aspect of the invention provides that the fracturing process comprises: isolating the target zone from areas of the HTIP that are not desired to be fractured such that pressue may be applied to the target zone with a fracture fluid, wherein an isolated target zone is defined; preparing a low viscosity, high-temperature, stable thixotropic fracturing-fluid; increasing the pressure as the isolated target zone in excess of a known minimum horizontal formation sizes of the target zone, with the low-viscosity, high temperature, stable, thixotropic fracturing-fluid: pumping with a calculated volume of a PAD; following the PAD pumping, adding propant into the PAD as it is pumped; ramping up propant concentration during the pumping, and ceasing pumping upon obtaining a predetermined maximum surface pressure.

Another aspect of the invention provides that the said isolating is performed with a split-ring and groovedcylinder packer.

Another aspect of the invention provides that the said isolating is performed with a low annuler clearance pucker.

Another aspect of the invention provides that the said installing comprises pumping, into the Diriciconductive fracture, a sealant, wherein said pumping continues to a point where a predetermined model predicts the sealant has substantially filled the horizontal width dimension and a penetrated to a pre-determined portion of the horizontal length dimension.

Another aspect of the invention provides that the said installing a fluid-impermeable barrier occurs after said creating a fluid-conductive fracture in the formation.

Another aspect of the invention provides that the said installing a fluid-impermeable barrier is at an interface between liquid and vapor in the fluid-conductive fracture.

Another aspect of the invention provides that the said installing a fluid-impermeable barrier comprises installing the barrier at the bottom of the fluid-conductive fracture.

Another aspect of the invention provides that the said installing a fluid-impermeable barrier comprises installing the barrier outside the fluid-conductive fracture, wherein a layer of high-temperature, impermeable rock resides between fluid-conductive fracture and the barrier, Another aspect of the invention provides that the said installing a fluid-impermeable barrier occurs before said creating a fluid-condctive fracture in the formation.

Another aspect of the invention provides that the said installing comprises; isolating a barrier location in the target area, and creating a short barrier fracture in the formation having the dimensions of a desired barrier and being shorter than a desired a fluid-conductive fracture, and pumping a barrier material into the barrier fracture.

Another aspect of the invention provides that the said installing a fluid-conductive fracture in the formation comprises: creating a first fluid-conductive fracture in the formation above the barrier, creating a second fluid-conductive fracture in the formation below the barrier, establishing a fluid communication connecting the first fluid-condcutive fracture and the second fluid-conductive fracture by continuing to enlarge the second fluid-conductive fracture in the formation rises around the barrier to connect with the first fluid-conductive fracture in the formation.

Another aspect of the invention provides that a process of operating a geothermal well having: a borehole with a generally-verticle trajectory in the high-temperature, impermeable rock, a fluid-conductive fracture at a target zone in a geologic formation of interest for geothermal energy production, the fluid-conductive fracture extending laterally from an axis of the borehole, wherein: the fluid-conductive fracture has a substantially-verticle dimension, a substantially-horizontal width dimension, and a substantially-horizontal length dimension, the substantially-verticle dimension is greater than the substantially-horizontal width dimension the substantially-horizontal length dimension extends radially from a borehole axis and is longer than the horizontal width dimension, within the fluid-conductive fracture, a fluid-impermeable barrier extends substantially-radially from the borehole, capable of diverting fluid under pressure on a first side of the barrier in the target zone to flow away from the borehole, around the barrier, and into the target zone on a second side of the barrier, the process comprising: forcing fluid under pressure on a first side of the barrier im the target zone to flow away from the borehole, around the barrier, and into the target zone on a second side of the barrier; and retrieving fluid from the second side of the barrier.

Another aspect of the invention provides that the a geothermal well in high-temperature impermeable rock, the well comparingL a borehole in a target zone in the high-temperature, impermeable rock: an induced, fluid-conductive fracture at a target zone in the high temperature rock includes said induced, fluid-condcutive fracture has: a substantially-verticle dimension, a substantially-horizontal width dimension, and a substantially-horizontal length dimension, the substantially-verticle dimension is greater than the substantially-horizontal width dimension the substantially-horizontal length dimension extends radially from a borehole axis and is longer than the horizontal width dimension, within the fluid-conductive fracture, a fluid-impermeable barrier extends substantially-radially from the borehole, capable of diverting fluid under pressure on a first side of the barrier in the target zone to flow away from the borehole, around the barrier, and into the target zone on a second side of the barrier, a tubing int eh borehole, wherein said tubing and said borehole define an annulus between said tubing and said borehole that is in fluid communication said induced fracture; a substantially impermeable barrier located in said induced fracture and extending to the substantially the entire width and toa portion of the length of said fracture; at least one isolator (e.g., a packer) located in said annulus capable of directing fluid fomr said annulus into said induced fracture on a first side of said barrier ans substantially preventing fluid entering past said annulus from said fracture on a second side of said barrier from crossing past said barrier through said annulus; wherein the interior of said whing isin fluid communicationwith saif annulus on the second side of said barrier.

Another aspect of the invention provides that a packer comprising: a cylinder having recesses positiond axially along said cylinder: compressible rings positioned in said cylinder, fasteners holding said compressible rings in a compressed position in said recesses: wherein said compressible rings have a compression-resistant force sufficient to effectuate a seal between said cylinder and a borehole located in a fluid condcutive fracture in a high-temperature impermeable rock suitable for geothermal operations wherein said seal is sufficient to direct a substantial portion of fluid circulating between said cylinder and said borehole into fluidconductive fracture.

Another aspect of the invention provides that the said cylinder comprises a completion string sub having threaded connections adapted for insertion in a completion string.

Another aspect of the invention provides that the said cylinder comprises a grooved sleeve having an axial opening accomodating installation of the sleeve around a completion string.

Another aspect of the invention provides that the said compressible rings comprise split spring steel rings.

Another aspect of the invention provides that the said rings have at least one chamfer on an outer edge.

Another aspect of the invention provides that the said fasteners comprise heat sensitive fasteners that prevent expansion of the rings until a particular heat is reached, releasing said rings.

Another aspect of the invention provides that the said fasteners comprise solder.

Another aspect of the invention provides that the said cylinder is modular, wherein a set of modules of the packer have at least one ring and the modules are connected in series.

Another aspect of the invention provides that the said modules comprise a threaded pin end and a threader box end arranged such that, when a pin of one module is fully engaged with the box of another, a gap exists between the outer diameter of the two modules, defining a groove of a cylinder of multiple, connected modules.

Another aspect of the invention provides that the a process for creating a seal in an annulus between a cylinder and a borehole located in a target zone in high-temperature, impermeable rock, the process comprising: extending to the high-temperature impermeable rock, rings from recesses in the cylinder, applying a force sufficient to substantially redirect fluid from the annulus into a fluid-conductive fracture at a target zone in the high-temperature, impermeable rock.

Another aspect of the invention provides that the said extending comprises releasing retainers applied to the rings to prevent the rings from expanding.

Another aspect of the invention provides that the said applying constaining by the borehole preventing the rings from expanding ro a relaxed, extended state.

BRIEF DESCRIPTION OF THE DRAWINGS

For a thorough understanding of the example embodiments, reference is made to the following detailed description of the preferred embodiments, taken in conjunction with the accompanying drawings in which reference numbers designate like or similar elements throughout the several FIGS. of the drawing. Briefly:

FIGS. 13-19 show examples of the invention in a sectional view.

DETAILED DESCRIPTION OF THE EXAMPLE EMBODIMENTS

Figure 1:
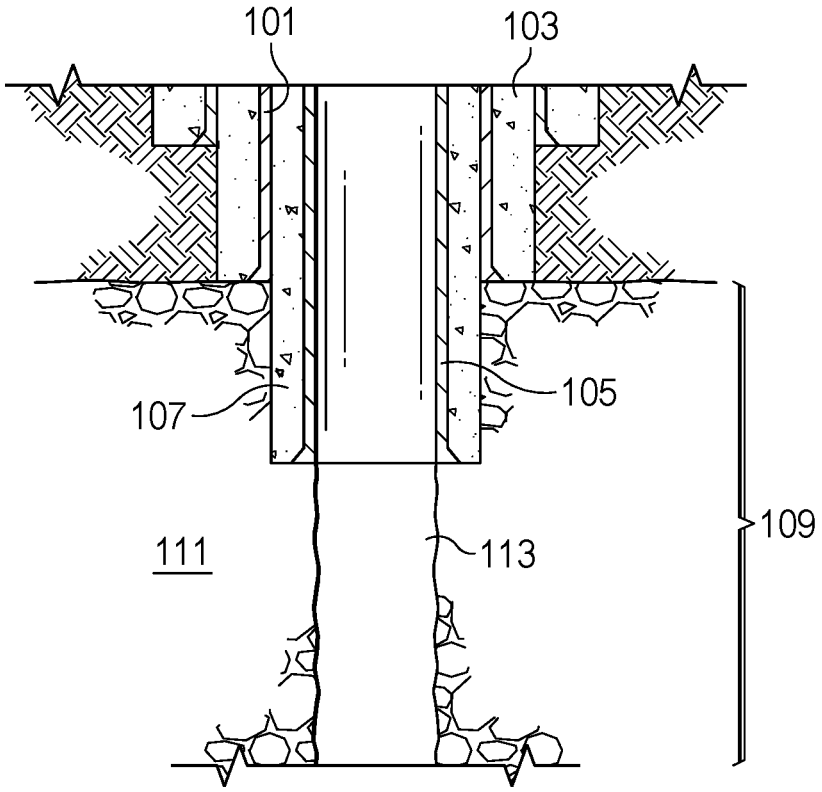
FIGS. 1-3 show examples of the invention in a sectional view.

Referring to FIG. 1, a cross-section of Hot Dry Rock is seen in which various aspects of the present invention are described. As seen, casing (101), cemented with standard Class G type well cement (103), casing (105) (alternatively, a liner), cemented with geothermal cement (107), have been placed in borehole (109) through high-temperature, impermeable rock (111), leaving an open hole area (113) of borehole (109) exposed. In various examples, the geothermal cement (107) comprises specially formulated calcium-aluminate cement for high-temperature geothermal wells. In one specific example, the geothermal cement comprises Calcium-Aluminate-Phosphate (CAP) cement.

Both Calcium Aluminate Phosphate (CAP) cement and Thermal Shock Resistant Cement (TSRC) are useful. In both, the major components are Calcium Aluminate Cement (CAC) (e.g., Secar #51 and Secar #80, respectively) and fly ash type F (FAF). Table 1, below, shows the starting materials composition of these CAC, API Class G Cement, and FAF. The X-Ray Diffraction (XRD) data identify three crystalline phases in CAC #80, corundum ($\alpha$-Al2O3), calcium monoaluminate (CaO·Al2O3, CA), and calcium dealuminate (CaO·2Al2O3, CA2) and CAC #51 has CA as its dominant phase, coexisting with gehlenite [Ca2Al(Al, Si)2O7] and corundum as the secondary components. Secar #51 is one of six calcium aluminate cement available in North America commonly used in refractories. Secar #80 is a cement blend designed to be the complete binder system for extreme duty in low water refractory castables. Kerneos Aluminate Technologies manufacture Secar products.

TABLE 1

| Component | Oxide composition, wt % | | | | | | | |
|---|---|---|---|---|---|---|---|---|
| | $Al_2O_3$ | CaO | $SiO_2$ | $Fe_2O_3$ | $Na_2O$ | $K_2O$ | $TiO_2$ | $SO_3$ |
| Class G cement | 2.9 | 66.0 | 18.0 | 3.8 | 0.3 | 1.3 | | 5.4 |
| CAC, #80 | 75.2 | 24.7 | — | 0.1 | — | — | — | |
| CAC, #51 | 45.1 | 49.7 | — | 2.8 | — | — | 2.4 | |
| FAF | 35 | 2.7 | 50.0 | 7.1 | 0.30 | 3.1 | 1.6 | |

In some examples, CAP is used in mildly acidic (pH~5.0) environments and for CO2 resistance; in alternative examples, TSRC is used when dry-heat/cold water cycles of over 500 degrees C. are expected for use in mildly acidic (pH~5.0) environments, and TSRC can withstand dry-heat—cold water cycles of more than 500 degrees C.

Figure 2:
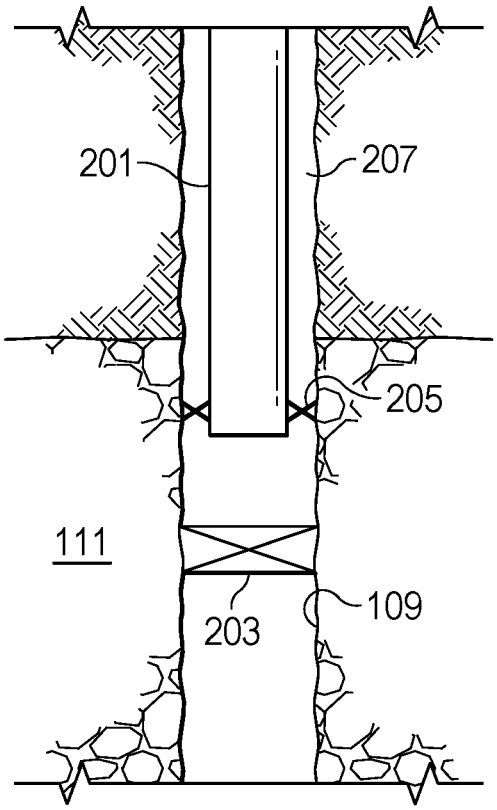
Figure 3:
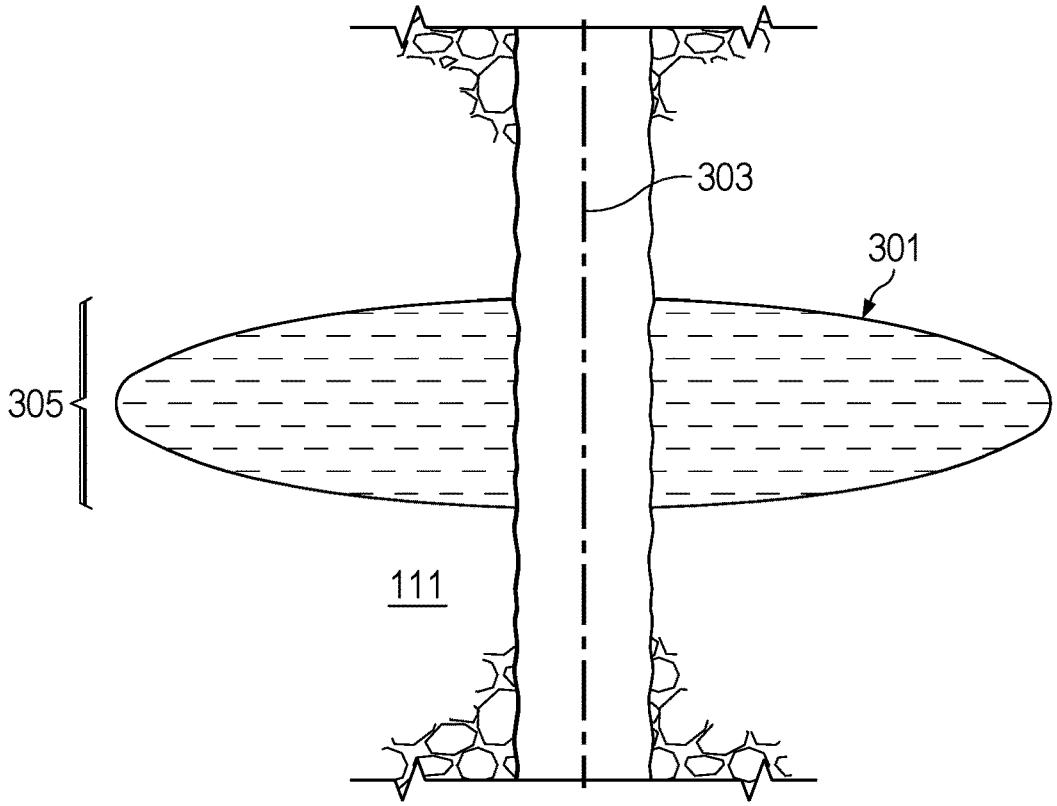
Figure 4:
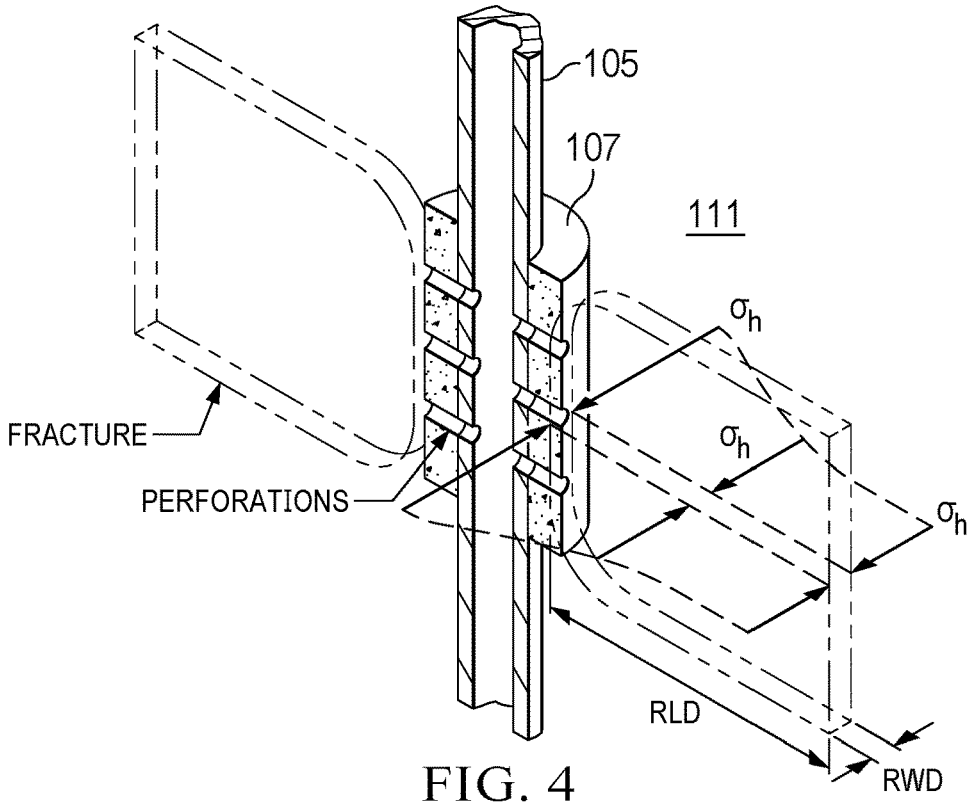
FIG. 4 shows an example of the invention in a 3D perspective view.

According to one aspect of the invention, a process is provided for creating a geothermal well in a geologic formation of interest (e.g., high-temperature, impermeable rock (111)), the process comprising:

sinking a borehole (109) (see FIG. 2) with a generally-vertical trajectory into the high-temperature, impermeable rock (111) (as seen in the illustrated example, borehole (109), whether cased or not, has a tubing (201) inserted with a bridge plug (203) sealing borehole (109) and a packer (205) isolating the annulus (207) formed between tubing (201) and borehole (109));

creating a fluid-conductive fracture (301) (see FIG. 3) in the formation, substantially-radially from an axis (303) of the borehole (109), at a target zone (305) in the geologic formation of interest for geothermal energy production (referring now to FIG. 4, the creating causes the fluid-conductive fracture (301) to have a substantially-radial length dimension (RLD) that is larger than a substantially-radial width dimension (RWD), wherein the radial length dimension (RLD) is longer than the radial width dimension (RWD)—such dimensions and their orientation to bore axis (303) occur presuming bore axis (303) is parallel to the natural axis of fracture in rock (111), which is typically vertical); and installing a flow-resistant barrier (501) (see FIG. 5) substantially-laterally from the borehole (109), wherein the barrier (501) is positioned to divert fluid under pressure on a first side (S1) of the barrier (501) to flow away from the borehole (109), around the barrier (501), and to a second side (S2) of the barrier (501).

In other examples (e.g., with offsets or horizontal boreholes), the radial dimensions will be at some angle to vertical. In at least some such examples, the natural plane of fracture is not vertical, and the borehole is drilled to be substantially parallel to the natural plane of fracture. In still other examples, the borehole is not substantially parallel to the natural plane of fracture.

Figure 5:
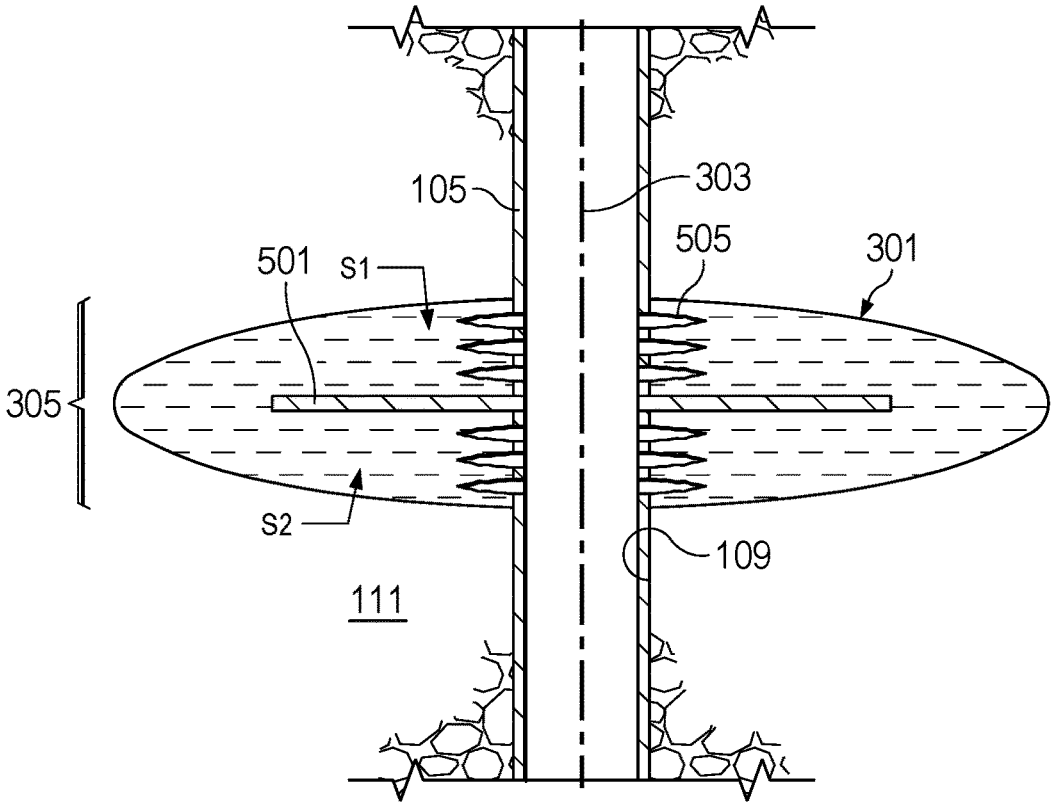
FIGS. 5-6 show examples of the invention in a sectional view.

As seen in FIG. 5, in some examples, a casing (105) is provided at the target zone (305), which is secured by means that will occur to a person of ordinary skill (for example, high-temperature cement, specific acceptable examples of which include: CAP and TSRC). In such examples, perforating operations are applied to create perforations (505) to access the formation in the target zone (305). Such perforation operations will occur to those of skill in the art without the need for further elaboration in this document.

In at least one example, the creating of a fluid-conductive fracture (301) comprises fracturing the high-temperature, impermeable rock (111) in the target zone (305) with a proppant (thus defining a "propped fracture"). In some examples, the fracturing process comprises: isolating the target zone (305) from areas of the rock (111) that are not desired to be fractured (such that pressure may be applied to the target zone (305) with a fracturing fluid, wherein an isolated target zone (305) is defined; preparing a low-viscosity, high-temperature, stable, thixotropic fracturing-fluid (for example, using freshwater, a low concentration (e.g., less than about 5%) of Polymerized Alkali Silicate (PAS) pre-pad); increasing the pressure at the isolated target zone (305), in excess of a known minimum radial formation stress of the target zone (305), with the low-viscosity, high-temperature, stable, thixotropic fracturing fluid. In at least one, more specific example, the preparing comprises adding fluid loss additives to the low-viscosity, high-temperature, stable, thixotropic fracturing fluid. In pre-fracture modeling, the height and length of the fracture are correlated with leakage of fracturing fluid. Adding fluid loss additives keeps more volume in the fracture, which increases the chance of the model of the height and length dimensions being correct.

In at least some examples, the increasing of the pressure comprises pumping the low-viscosity, high-temperature, stable, thixotropic fracturing-fluid (sometimes called a "pre-pad fluid") at about 8-12 BPM (barrels per minute). In further examples, the process also includes controlling the initial fracture height by following pre-pad pumping with a calculated volume of a PAD (e.g., a higher viscosity fracturing fluid (e.g., a 10% PAS)). In some examples, the PAD pumping is followed by adding proppant into the PAD as it is pumped. The proppant concentration is ramped up during the pumping, and pumping ceases upon obtaining a predetermined maximum surface pressure created by the pre-fracturing model.

In some examples, the pre-fracturing modeling is prepared by modeling software that will occur to those of skill in the art, based on pre-fracturing measurements of the target zone from, for example, seismic data, well log data, samples of material from the borehole (109), and other information that will occur to those of skill in the art, applying formulae and other presumptions that are common in the art and require no further elaboration.

Figure 6:
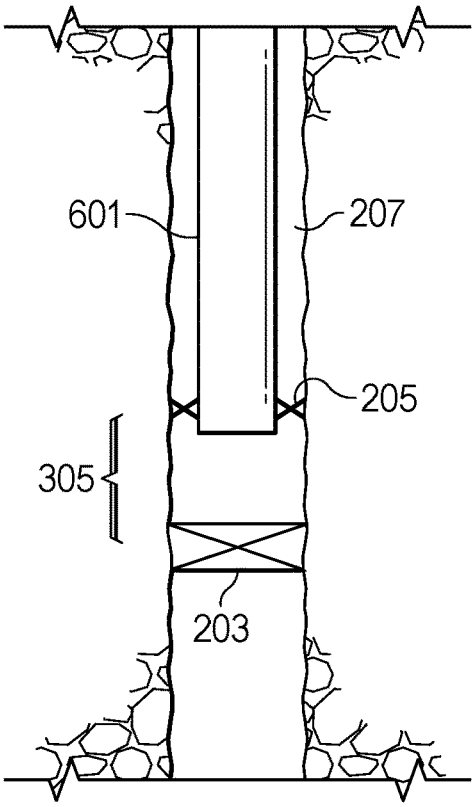

Referring to FIG. 6, an "open borehole" (i.e., uncased target zone) example arrangement is seen for the previously mentioned isolating of the target zone (305) from areas of the rock (111) that are not desired to be fractured, such that pressure may be applied to the target zone. In such an example, a packer (205) is installed up-hole of the target zone (305), fluidically isolating the target zone (305) from areas below the bridge plug (203). Fracture tubing (601) is positioned with packer (205) up-hole from the target zone (305), isolating the target zone (305) from portions of the annulus (207) defined between the target zone (305) and fracture tubing (601). Pumping proppant-containing fracturing fluid, as in the cased-hole example above, causes a conductive fracture (301) to be created.

Referring now to FIG. 5, in some examples, the installing of a flow-resistant barrier, potentially thousands of feet in length, comprises pumping a fluid containing proppant and/or other materials into a barrier portion of the fracture (301) that will inhibit fluid flow through the barrier portion. Such a barrier need not be substantially impermeable in some applications; in some such applications, having a barrier that is significantly less conductive than the conductive fracture in which it resides is sufficient. In other applications, a substantially impermeable barrier is desired to increase the extent of the travel of the heat carrying fluid across the surface area of the hot rock the fluid contacts.

Referring again to FIG. 5, in some applications, the installing of the flow-resistant barrier comprises pumping a barrier, into the target zone (305). In one such example, pumping a propped sealant is performed (for example, a self-setting slurry material, consisting of an internally catalyzed high-temperature sodium silicate (HTSS), a liquid hydrocarbon, epoxy resin, and others that will occur to those of skill in the art. In at least one such example, the pumping continues to a point where a predetermined model predicts the sealant has substantially filled the radial width dimension (RWD) (see FIG. 4) and penetrated to a pre-determined portion of the radial length (RLD). In some examples, the predetermined portion is less than 100% (for example, when the initial fluid-conductive fracture is the only fluid-conductive fracture for a stage in the well). Alternatively, the portion may be 100% of the length dimension, when further fractures below the barrier will define a fluid communication path around the barrier.

The barrier's ultimate competence against thermal, chemical, or hydraulic degradation, is defined by gel strength, compressive strength, toughness factors, permeability, and ability to deflect fracturing stresses during fracturing operations, may be increased by use of an adequate viscosity carrier, for example HTSS containing solid or semi-solid particles. Analogous to a mortar, an example adequate viscosity carrier, HTSS, may carry small aggregate type particles, sized adequately to pass through a propped fracture's pore spaces according to Penberthy principles, such as bentonite, silica flour, sands, ceramics, polyester or other natural or unnatural fibers, high-temperature, expandable, rubbers, coal dust, solid hydrocarbons, metallics, mineral based, and oil dispersible clays. Other carrier and aggregate materials include alkali-aluminosilicates containing pozzolan or fly ash type additives; organic fluid systems; cementitious material combinations, such as cement-fly ash, cement-lime, or cement-calcium hydroxide/hydrocarbon coated calcium chloride mixtures; activated chemicals; and others that will occur to those of skill in the art.

Figure 7:
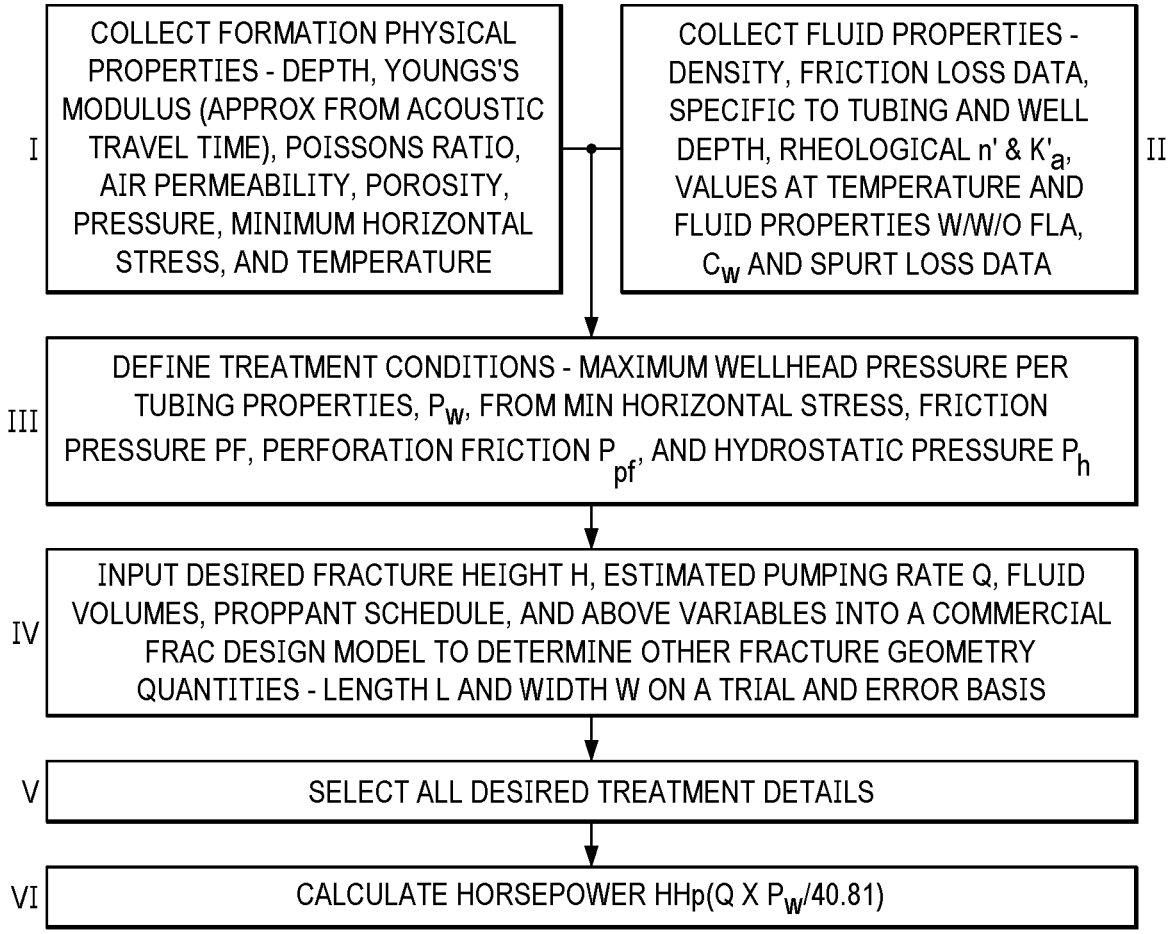
FIG. 7 shows an example process useful according to the invention in a chart view.

Referring now to FIG. 7, in at least one alternative application, the installing of the flow-resistant barrier comprises pumping a substantially-impermeable fluid-barrier into an induced non-substantially fluid-conductive (non-propped/pre-pad) fracture. In at least one more specific example, a fracture is prepared for later passing diverted hydraulic heat flow with an example Frac Treatment Simulation Modeling software flowchart. In the illustrated example, the software incorporates pertinent formation characteristics collected from previous collection and analyses. Such characteristics include at least some of the following: static bottom hole temperature, rock Young's Modulus, Poison's ratio, minimum horizontal stress, fluid saturation, permeability and porosity, formation height, formation pressure, nominal drainage radius, and borehole geometry. The Frac Treatment Modeling software, which is known to those of skill in the art, is used to design a propped fracture with controlled length and height (in this example, the process is for fracturing and propping).

Figure 8:
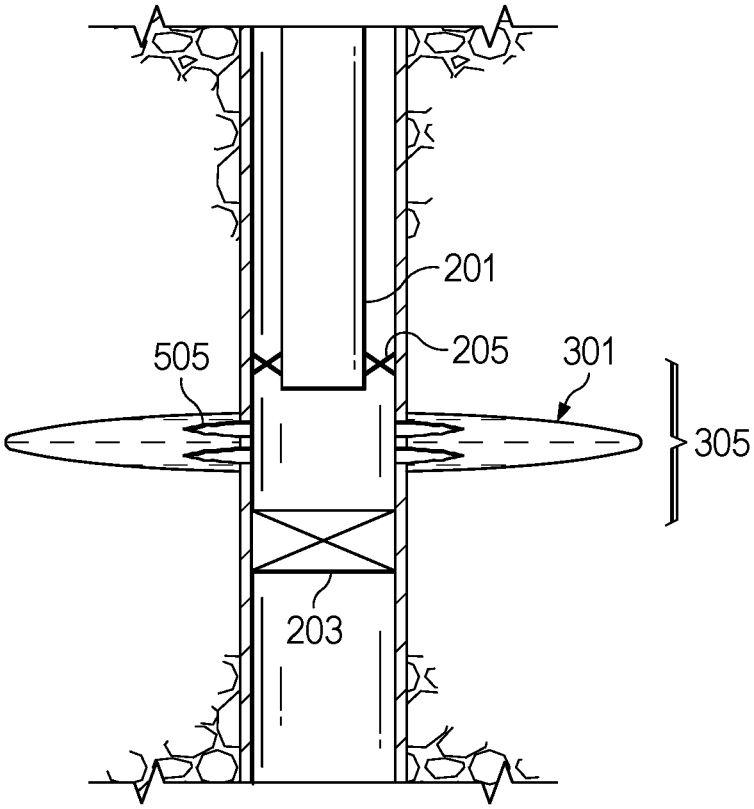
FIGS. 8-12 show examples of the invention in a sectional view.

Referring now to FIG. 8, in one such example, a short height fracture location is identified and isolated with packer (205) and bridge plug (203) within target zone (305). Perforations (505) (in the case of a cased borehole) are made through the casing, and a short-height fracture (not shown) having the height, length, and width, required for a barrier, is created.

Figure 9:
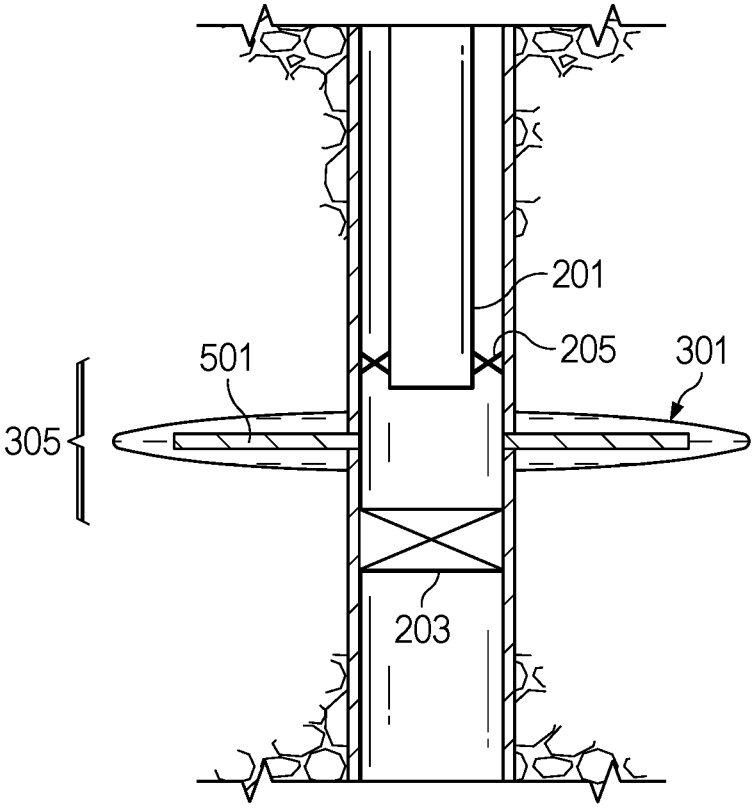

As seen in FIG. 9, material to create barrier (501) is pumped into the short-height fracture.

Figure 10:
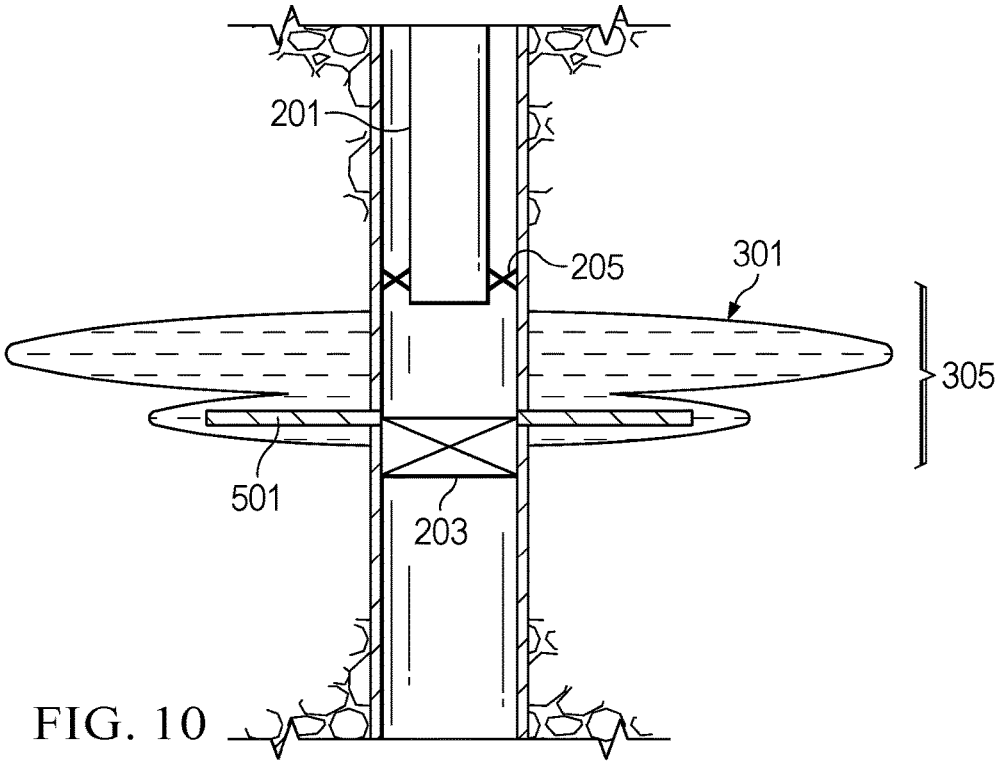

Referring now to FIG. 10, then, packer (205) and bridge plug (203) are moved to isolate the upper portion of target zone (305) above barrier (501), and a fluid-conductive fracture (301) is created above barrier (501).

Figure 11:
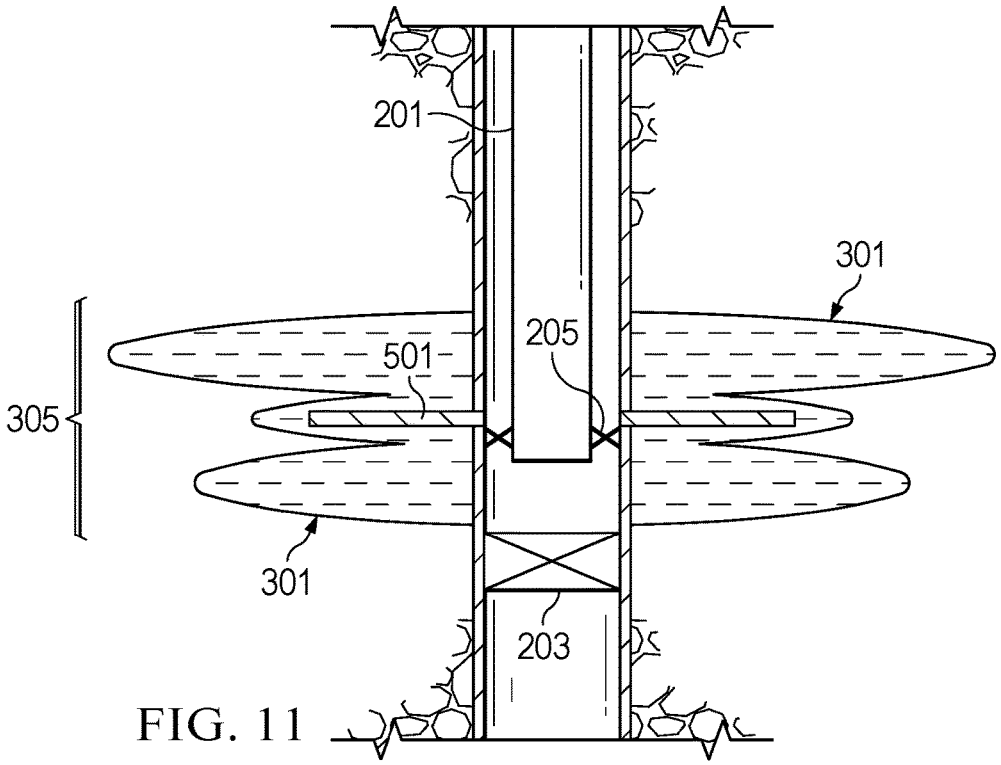

Referring now to FIG. 11, packer (205) and bridge plug (203) are moved to isolate the lower portion of target zone (305), below barrier (501), and a fluid-conductive fracture (301) is created below barrier (501).

Figure 12:
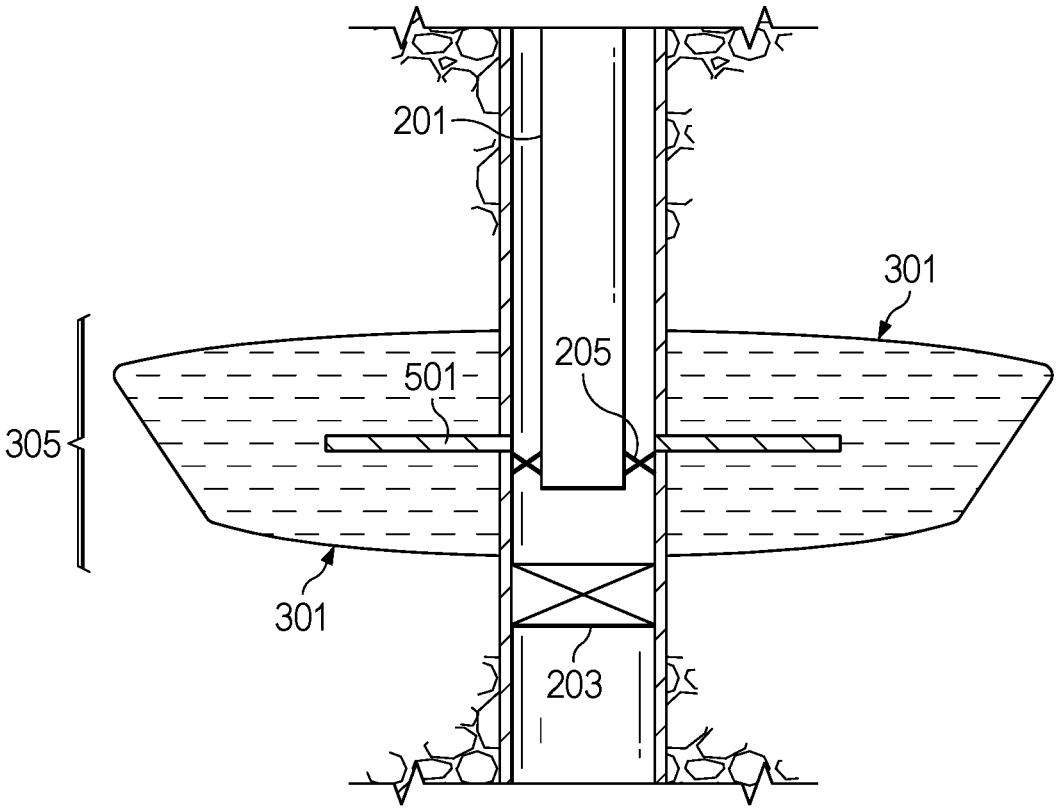

Referring now to FIG. 12, in the creation of a fluid-conductive fracture (301) below barrier (501), pumping continues to extend lower fracture (301) beyond barrier (501); lower fracture (301) then rises due to pressures in the rock in target zone (305) to meet the upper fluid-conductive fracture (301) above barrier (501) resulting in one continuous fluid-conductive fracture (301) in fluid communication barrier (501).

Thus, when production fluid (e.g., water) is pumped into the target zone (305) above barrier (501), the fluid passes around barrier (501), picking up heat as it flows back to borehole (109). In some instances, the establishing of the fluid communication comprises continuing to enlarge the second fluid-conductive fracture (301) beyond the ends of the barrier (501) until the second fluid-conductive fracture (301) rises around the barrier (501) to connect with the first fluid-conductive fracture (301) in the formation.

According to still a further example, a somewhat permeable barrier is used in production. Such a barrier could be made from proppants with greater particle size distribution to substantially reduce conductivity. In at least one example, the fluid-conductive fracture is made from 20/40 mesh proppant. An at least somewhat permeable barrier is made from about 100 mesh proppant and silica flour particles; such a scenario gives an estimated 1000 orders-of-magnitude permeability difference.

Setting behaviors of barrier sealants include any or combinations of swelling, gelling, polymerization, hydrating, dehydrating, heating, coking, hardening, and solidifying to provide barrier competency.

In some examples, a bond is created between the sealant barrier material and the fractured rock. Created bond types include molecular, chemical, thermal or other reactions as results when amorphous silica bonds to molecular silica in rock (111). In other examples, a seal is created through rock closure pressure between the barrier material and the formation. In further examples, an adhesive bond results from the use of, for example epoxy resin.

In some other examples, created seal types include continuous (from bonding); microfracture at the formation-barrier interface, wherein rock closure pressure seals off the fractured formation, firmly holding all fracture constituents in place; and mechanical seals. Continuous seals function due to imperviousness. Microfracture seals function by creating high friction pressure losses. Mechanical seals function by surface interference. In still further examples, a barrier seal consists essentially of elastic, outward-biased, dynamically-swelling elastomeric material particles (for example, PTFE, neoprene, and others that will occur to those of skill in the art).

In another example, the creation of a barrier seal, whether before or after the fluid-conductive fracture (301), is performed with larger solid particles, and creating a sealed fracture and barrier in one operation.

Figure 13:
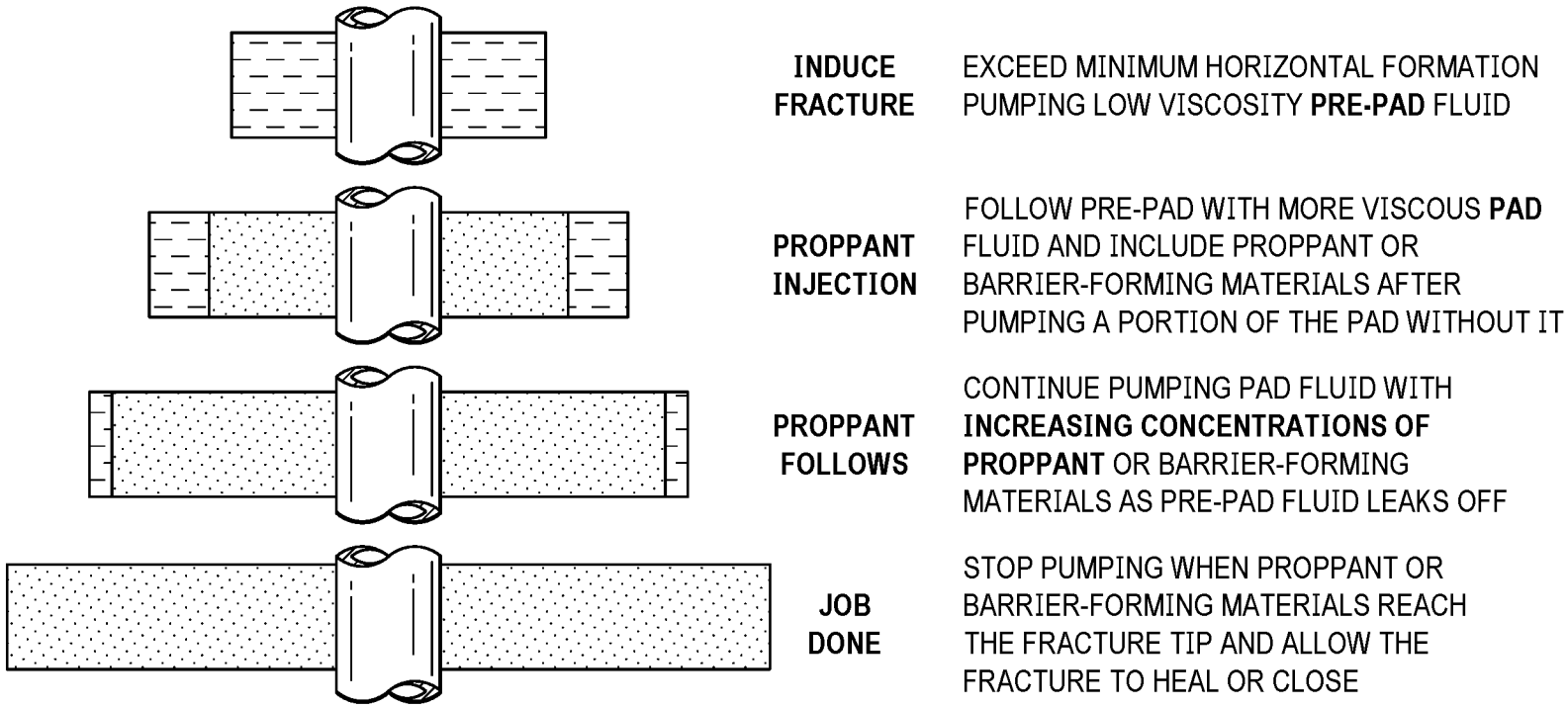
FIG. 13 shows and example of the invention in a side view.

In at least one, more specific version of the above operations, presuming a cased hole, the following steps are performed:

a. perforating via wireline or tubing conveyance to the target zone (305) per the fracture design model, especially targeting desired bottom hole temperature and rock characteristics.

b. installing a bridge plug (203) below the target zone (305).

c. inserting the tubing string (201) with retrievable packer (205) into the wellbore, and setting packer (205) above target zone (305), thereby isolating the tubing/casing annulus, pressure testing packer (205) and bridge plug (203) (with freshwater or clean brine), and monitoring pressure to verify integrity.

d. initiating a fracture by pressuring to more than the known minimum horizontal formation stress, pumping the designed volume of premixed pre-pad fluid consisting of low viscosity water with heat resistant fluid loss additive(s), such as silica-based particles, at an estimated 20 BPM to BPM rate. Referring to FIG. 13, which illustrates the pertinent phases of fracture creation, prepare pre-pad, a low viscosity, high-temperature stable thixotropic fracturing fluid. Mix frac design volume. In a specific example, first, a fracture is induced by exceeding the minimum horizontal formation stress by pumping low viscosity pre-pad fluid with freshwater or a low concentration (<5%) Polymerized Alkali Silicate (PAS). Next, the pre-pad is followed by a more viscous PAD fluid and includes proppant or barrier-forming materials in freshwater, for example, a higher (5% to 10% concentration) Polymerized Alkali Silicate (PAS) pad making a high viscosity, high-temperature stable thixotropic fracturing fluid. In some examples, frac design amount is mixed by blending a gradually ramped-up concentration (e.g., 0.5-lb/gal, 1-lb/gal, 2, 3, etc.) of, for example, aluminum oxide type proppant or barrier forming materials into the more viscous PAS fluid, sizing it according to fracture width and anticipated fracture closure stress that can reduce proppant conductivity. Next, the pumping of the PAD fluid continues but with increasing concentrations of proppant or barrier-forming materials (proppant-laden thixotropic PAS) at this higher rate until the fracture is filled. Next, pumping is stopped when proppant or barrier-forming materials have filled the fracture to the fracture tip according to frac model predictions; the fracture is thereby allowed to close.

e. wait for the viscosity of PAS fluid to lessen or break back before continuing well operations.

f. Unseat packer (205) and bridge plug (203) and prepare for the next well operation.

Figure 14:
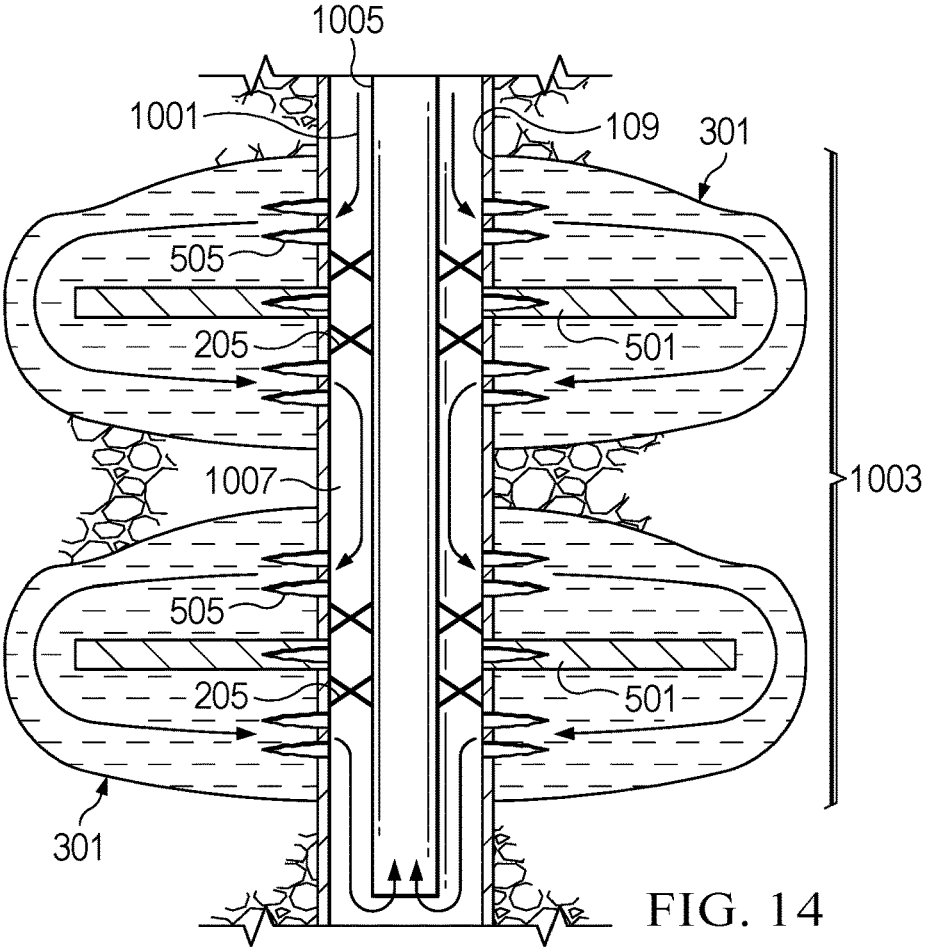

Referring now to FIG. 14, in operation, after one of more production stages (1003) of fluid-conductive fractures (301) with a barrier (501) are created. Creation of multiple stages (1003) is provided forming a set of stages in the same hole, as will occur to those of skill in the art from the present description without the need for further elaboration. Then, for production, a tubing (201) is inserted in borehole (109) (a cased borehole with perforations (505) in the illustrated example; however, the same description for an un-cased borehole as provided herein will apply, except for the lack of the presence of perforations (505)). On tubing (1005) reside packers (205), at least one above and at least one below the barrier (505) for each stage (1003). The packers isolate the production annulus (1007) that is defined between tubing (1005) and the inner diameter of borehole (109) at barrier (501). Then, when production fluid (1001) is circulated in the production annulus (1007), it passes through perforations (505) into fracture (301) above barrier (501) and returns to through perforations (505) to production annulus (1007) below barrier (501) in each stage, picking up heat from fracture (301) as it goes. As seen, fluid (1001) (for example, water), is pumped down annulus (1007) and up the interior of tubing (1005). However, in alternative embodiments, the pumping is reversed from what is illustrated.

Figure 15A:
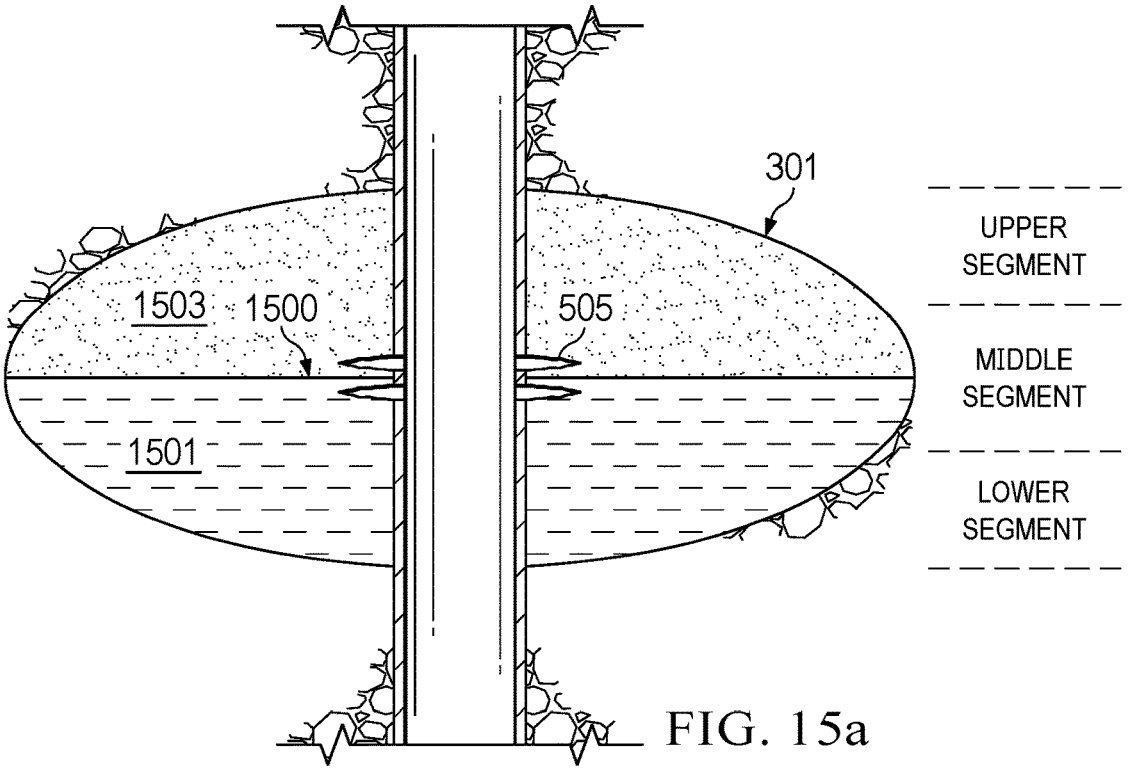

Referring now to FIG. 15*a*, in some example processes, the installing of a fluid-impermeable barrier (501) occurs after creating a fluid-conductive fracture (301). In the illustrated example, the fluid-impermeable barrier (501) is to be placed at an interface (1500) between remnant fluid (1501) and vapor (1503) in the fluid-conductive fracture (301); such an interface is created as a result of a vapor layer forming in the fracture from the heating residual fluids from the fracturing process. In such an example, there is no need to create a specific fracture for the barrier itself. Rather, a barrier material is injected into the fluid-conducting fracture (301) at fluid-vapor interface (1500) (or, in the alternative, when there is no interface (1500), at the most downhole portion of the fluid-conducting fracture (301)).

Figure 15B:
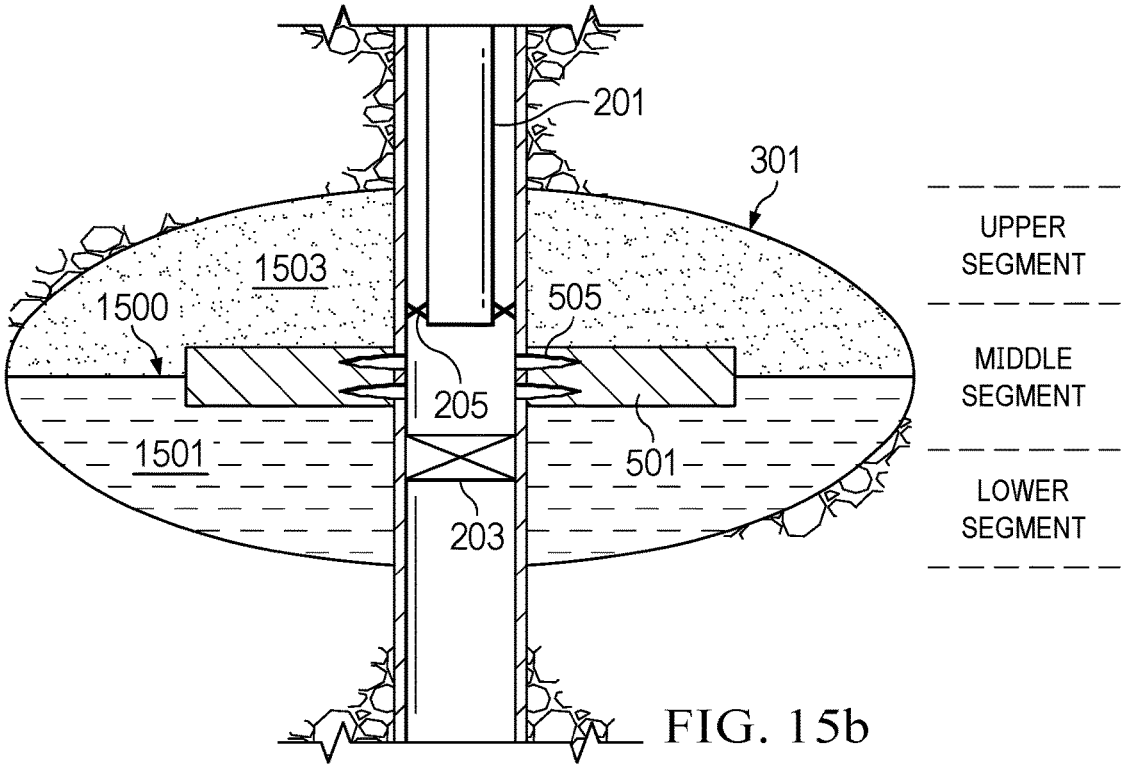

As seen in FIG. 15*b*, packer (205) and bridge plug (203) isolate perforations (505) that are located at interface (1500) in the middle segment of fracture (301). A barrier (501) is injected according to processes described elsewhere in this document. In some examples, a single barrier layer is provided, while, in other examples, multiple barrier layers are installed.

Figure 16A:
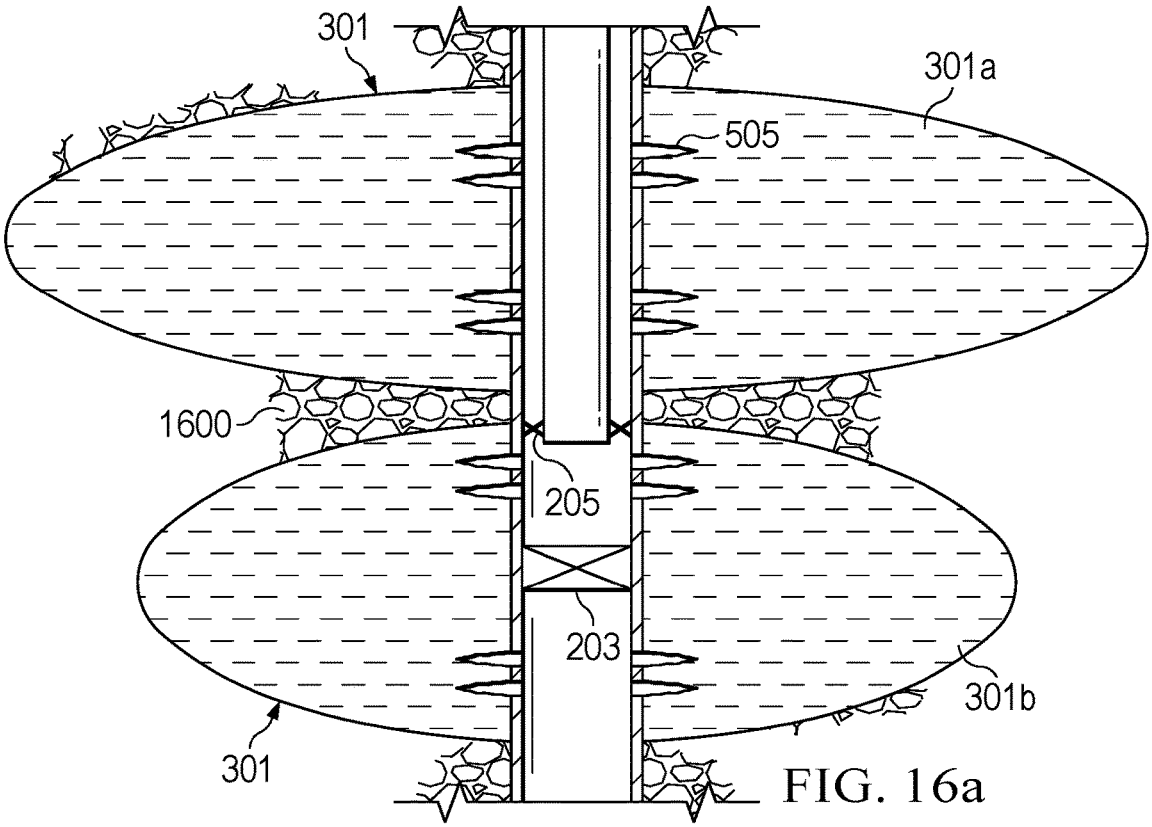

Referring now to FIG. 16*a*, in still further examples the installing of a fluid-impermeable barrier (501) comprises installing the barrier (501) outside of an upper, "long" fluid-conductive fracture (301*a*) and a lower, "short" fracture (301*b*), wherein a layer of impermeable rock (1600) is left between the fluid-conductive fractures (301*a*) and (301*b*). In the illustrated example, abridge plug (203) is installed with a packer (205) to isolate the fracture (301*b*) below rock (1600). Barrier material is injected through the perforations (505) that are located within the isolated zone.

Figure 16B:
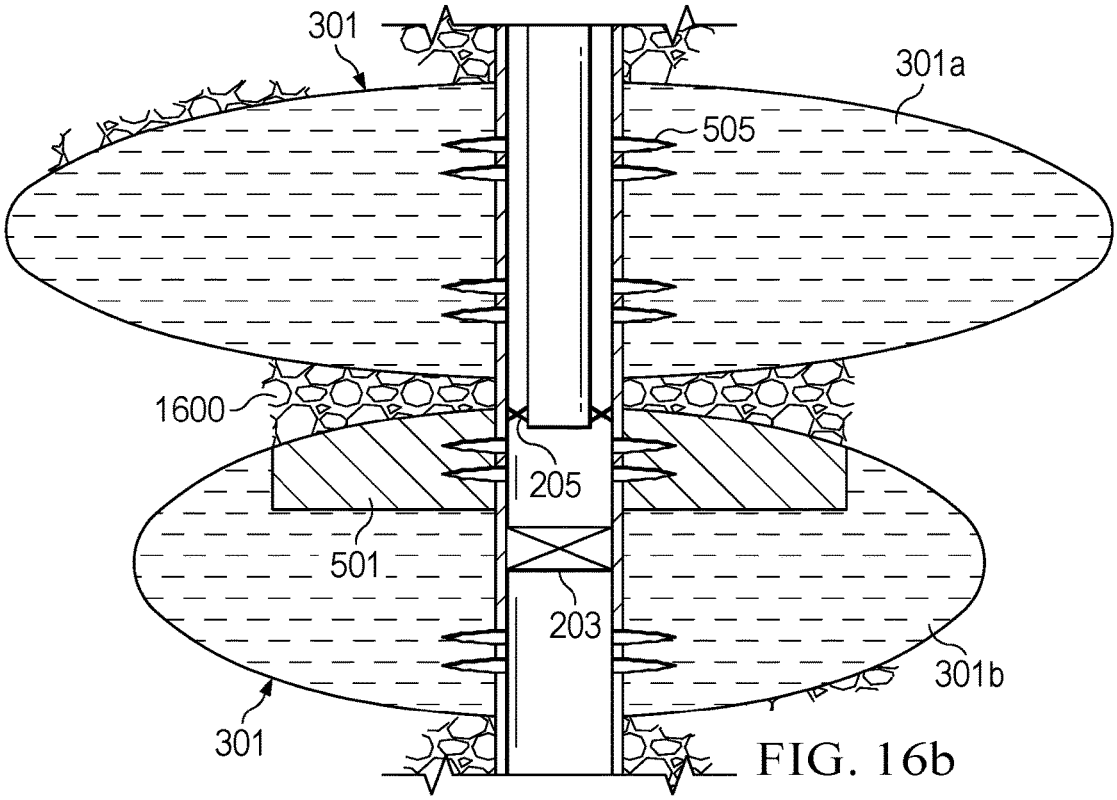

As seen in FIG. 16*b*, the barrier (501) forms up against the rock (1600), which will prevent fracturing of rock (1600) above the barrier during further fracturing operations to extend short fracture (301*b*) up to long fracture (301*a*).

Figure 16C:
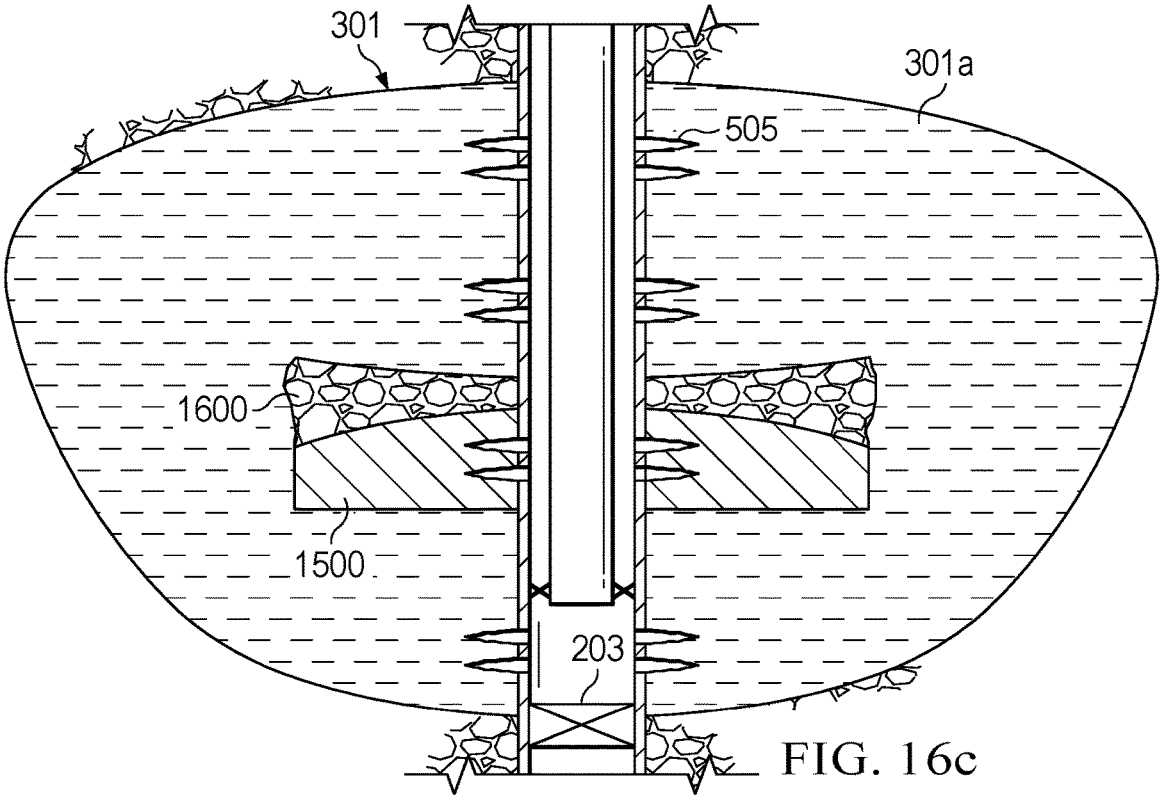

As seen in FIG. 16*c*, lower perforations (505) are then isolated, and further fracturing is performed in short frac (301*b*) to extend it up and around barrier (501) to be in fluid communication with long frac (301*a*).

Figure 17A:
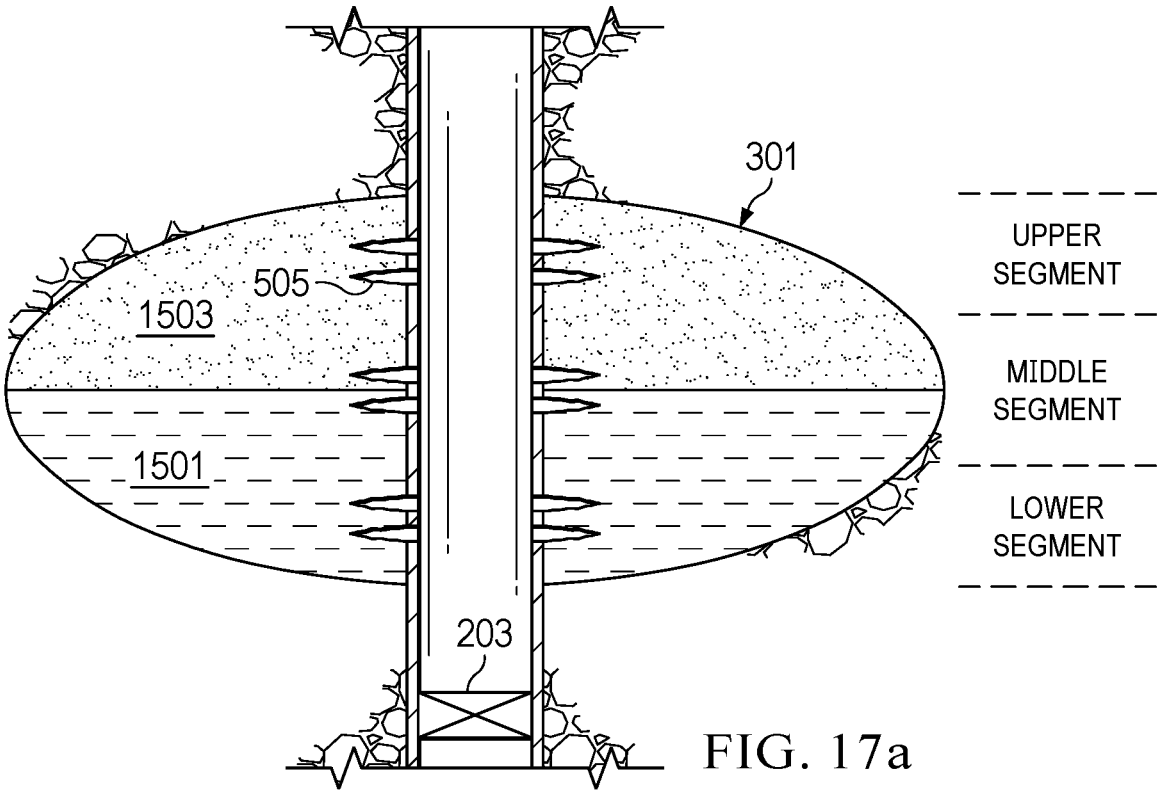

Referring now to FIG. 17*a*, in some examples, a simultaneous installation of a temporary barrier guide material and permanent barrier material (a so-called "isoflow technique") is provided. In at least one such example, a propped, fluid-conductive fracture (301) is created using three discrete perforation stages (505) and is controlled to leave a remnant fluid (1501) of a first density and viscosity residing in the fracture (301).

Figure 17B:
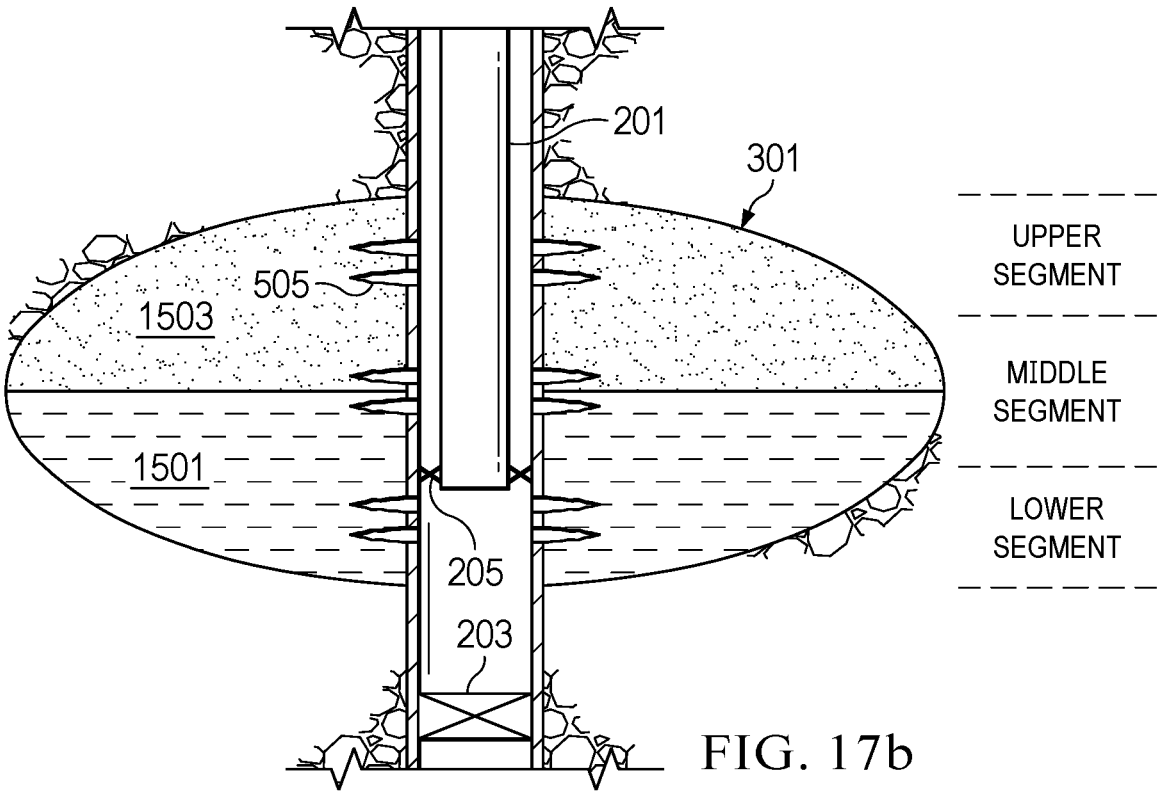
Figure 17C:
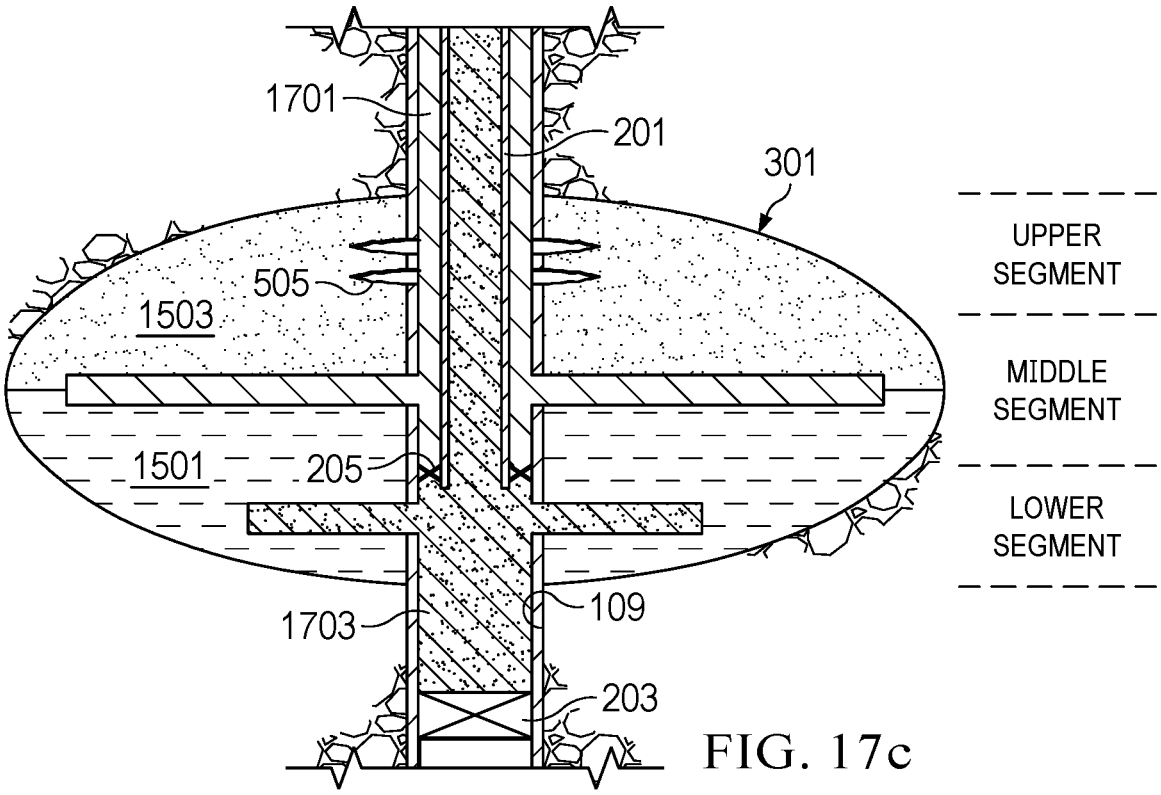

Referring to FIG. 17*b*, the middle and lower perforation are then isolated from each other; and, as seen in FIG. 17*c*, a barrier fluid having a density that is greater than the remnant fluid residing in the propped fracture is pumped through the upper and middle perforations. Simultaneously, a second fluid (1703) (e.g., brine) that is denser than the barrier fluid is pumped through the lower perforation into the propped fracture. During the pumping, an barrier fluid/brine interface will form between the middle and lower perforations, and the barrier will form from the barrier fluid at the interface. Although shown as extending axially from the borehole (109), the second fluid will rise to support first fluid. The specific gravity and viscosity of the fluids are pre-designed according to modeling that will occur to those of skill in the art, such that the fluid pumped through the lower perforations will prevent the barrier fluid from descending uncontrollably in the propped fracture. To gain access to the upper portion of the fracture (301), the upper perforations may be re-perforated and fracturing occurs again through them.

Figure 17D:
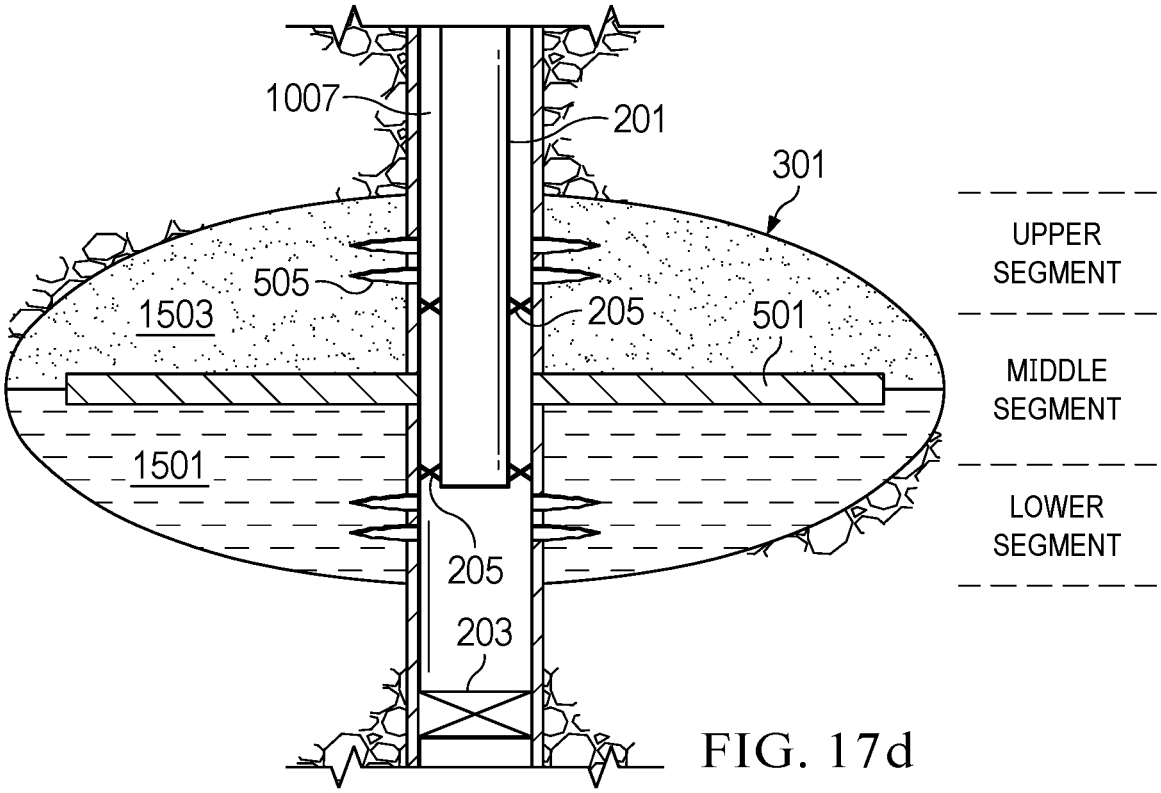

Referring to FIG. 17*d*, the middle and upper perforations (505) are then isolated from the lower perforations (505), both of which are then in fluid communication with the propped fracture (301) through production annulus (1007) and tubing (1005). A displacing fluid (that will occur to those of skill in the art) is then pumped through the upper perforations, which flows around the barrier and displaces the brine out of the propped fracture (301), through the lower perforations, and up the tubing (301).

In some alternative examples, the temporary guide fluid (1703) is pumped first, through the lower segment perforations, and the barrier fluid (1701) is pumped second, through the middle perforations.

Figure 18A:
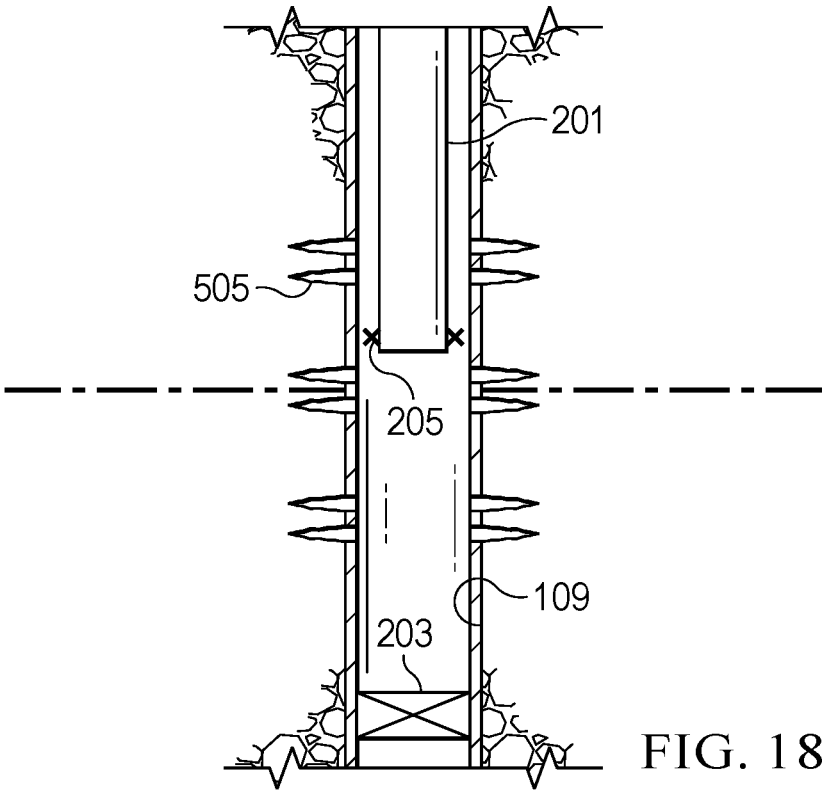
Figure 18B:
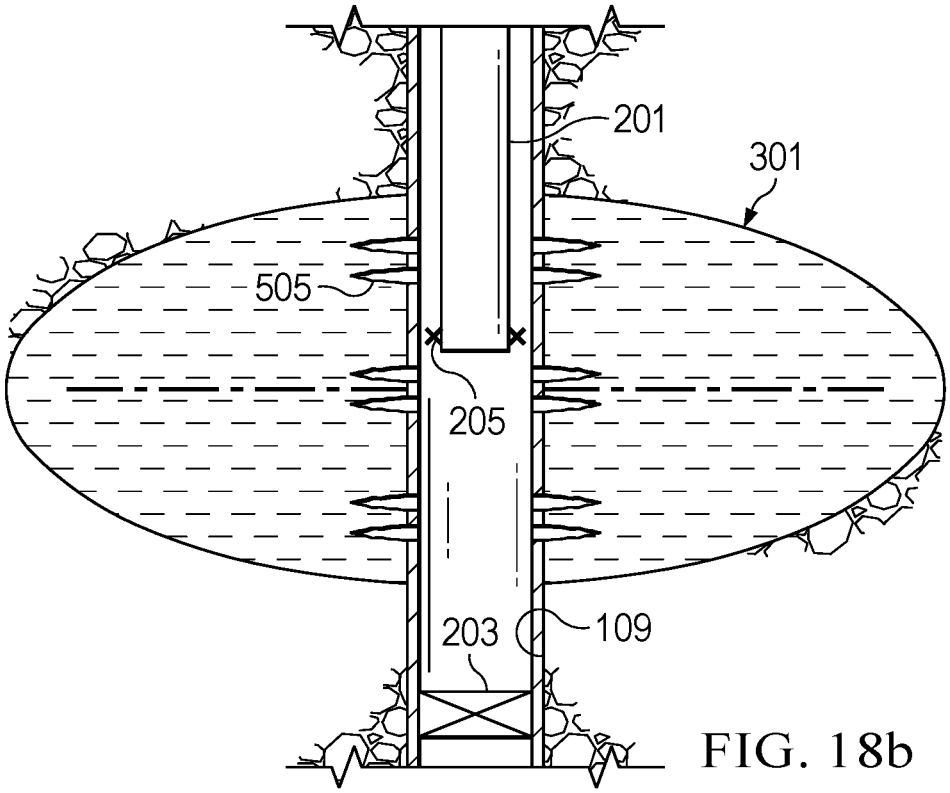

Referring now to FIG. 18*a*, in still another example, a packer (205) is placed unseated between tubing (201) and borehole (109), and (referring now to FIG. 18*b*), a propped fluid-conductive fracture (301) is created by using a relatively high-viscosity slurry. After the fracture (301) is sufficiently large, without stopping pumping, the slurry is changed to a lower viscosity barrier slurry. The lower viscosity barrier slurry will then hydraulically finger through the higher viscosity material and suspended proppants in the fracture, thus creating a barrier in the widest portion of the fracture (which will be in the centerline). In at least one example, a high viscosity, low proppant concentration (e.g., 0.5 lb. to 2 lb. per gallon slurry proppant), referred to as a "Perfect Proppant Carrier" (a slurry where proppant does not settle), is pumped. This creates a fluid-conductive fracture (301).

Figure 18C:
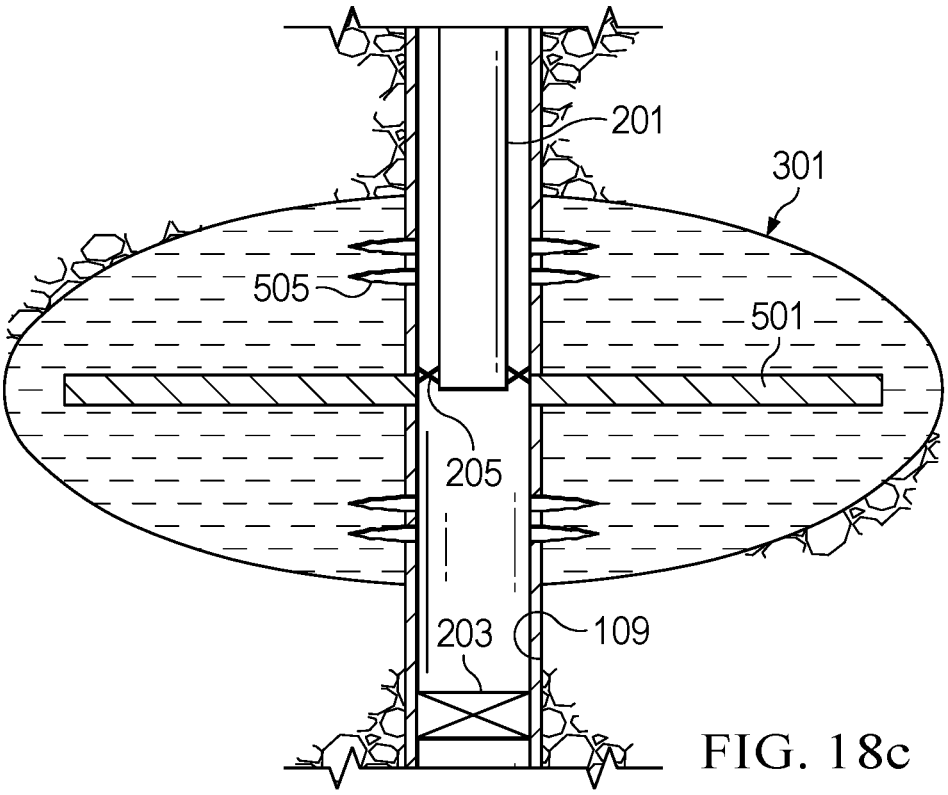

As seen in FIG. 18*c*, while continuing to pump the Perfect Proppant Carrier, packer (205) is seated, and then a barrier material is pumped behind the Perfect Proppant Carrier through the middle perforations (505). The barrier material does not penetrate the lower perforations (505) because of the proximity of the tubing-slurry discharge to the fracture's widest point, the addition to the less viscous slurry of FLA (fluid loss additives) that prevents the formation of smaller branching fingers (known in acidizing fields as "worm holing"), and the momentum of the "fingering" type flows (due to mobility differences of the less viscous barrier slurry through the high viscosity pad). Mobility differences are defined as a viscosity differential between the two fluids. Thus, a barrier is created in the widest portion of the fracture.

Perfect particle transport and suspension viscosity depend on particle diameter, density, and concentration, roughly in the range of 3 to 35 centipoise. Substantial viscous fingering occurs if a low viscosity fluid at 1-3 centipoise is injected into a syrup viscosity liquid ranging from 50 to 200 centipoise.

Figure 19A:
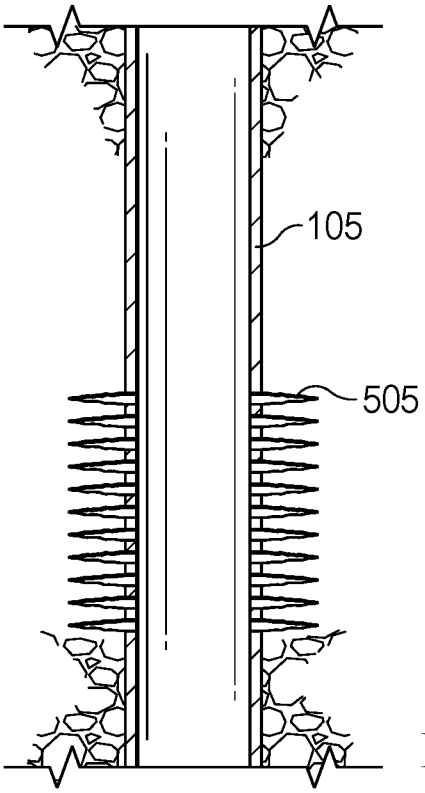

Referring now to FIG. 19*a*, yet another example is illustrated, assuming an ultimate 225 ft height frac model. As seen, an initial 150 ft perforation stage (1900) is made in casing (105).

Figure 19B:
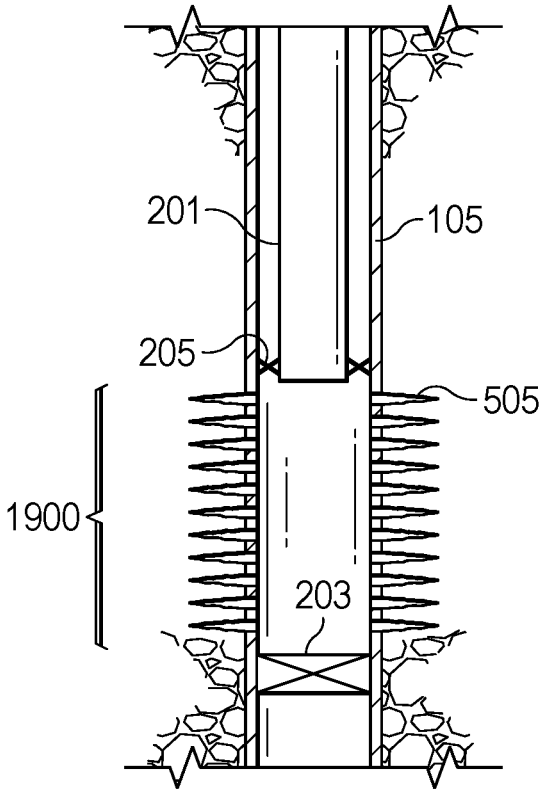

As seen in FIG. 19*b*, a bridge plug (203) below lowermost perforations and packer above the perforations in tubing (201) are provided to isolate perforation stage (1900).

Figure 19C:
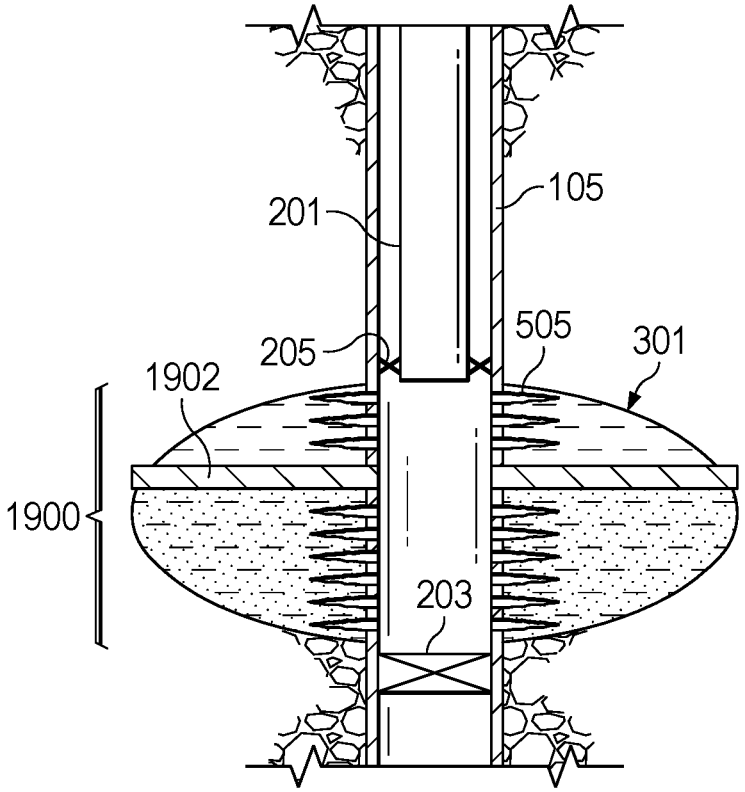

Referring now to FIG. 19*c*, a 150 ft tall fracture is created through perforation stage (1900). The fracture's approximately bottom half is propped; the top half is not. Along the length of the approximately upper one-third of the propped fracture (301), a limited conductivity barrier (1902) is formed. Pumping of appropriate pre-pad volumes and subsequent PAD with a viscosity allowing proppant settling in the created fracture is performed (using, for example, a 20/70 mesh proppant blend). Next, a proppant blend (containing, for example, Iodine 131) is pumped at a rate and viscosity that allows a gradation of the larger proppants settling towards the bottom of the fracture, while smaller, less conductive proppant particles accumulate in the middle of the fracture, creating a middle-fracture region having less fluid conductivity than the lower portion of the fracture, which defines limited conductivity barrier (1902). The smaller particles settle, thus creating a semi-permeable barrier (1902) approximately 75 ft from either of the fracture's vertical boundaries.

Figure 19D:
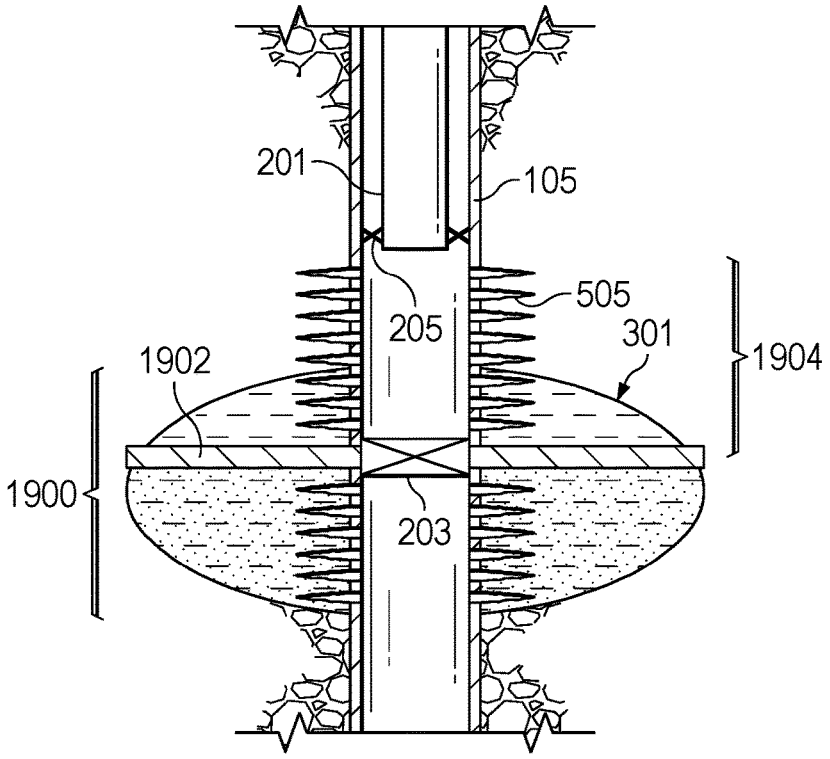

Referring now to FIG. 19*d*, a gamma-ray detector is used to detect the settled proppant barrier height. Bridge plug (203) is then relocated on top of barrier (1902). Then, an additional 75 ft above the original 150 ft interval perforation stage (1900) is perforated, creating perforation stage (1904).

Figure 19E:
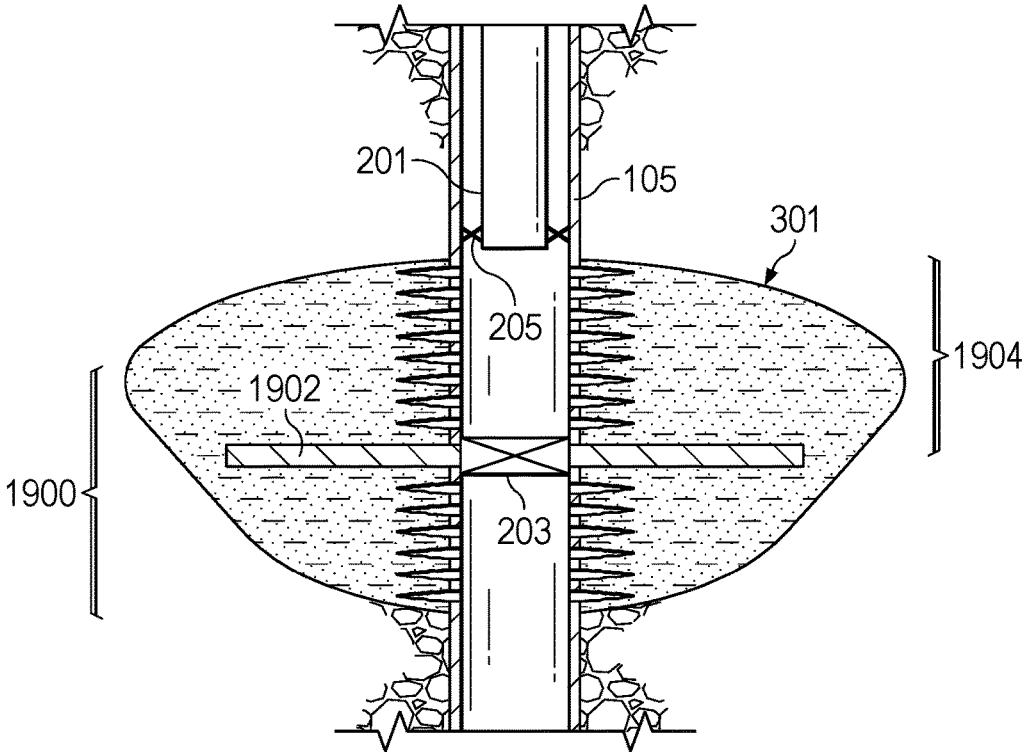

Referring now to FIG. 19*e*, after creation of perforation stage (1904), tubing (201) with packer (205) are installed with packer (205) set above the perforation stage (1904). Because the upper part of fracture (301) did not have proppant, the fracture in the upper part may close quickly; therefore, the new 150-foot perforation stage (1904) is used to refracture and extend the upper portion of fracture (301) as a complete fluid-conductive fracture (301). The proppant for the second fracture is performed with a larger single mesh proppant (e.g., 20/40 mesh). The designed volume of the second proppant carrying fluid will extend beyond the length of the settled proppant barrier causing higher conductivity 20/40 mesh proppant to propagate fracturing in all directions, including downwards once the fracture extends beyond the initial fracture (301). Thus, the first and second fractures are connected hydraulically beyond the end of barrier (1902). Upon fracture closure, the 150 ft height above the barrier (1902) will be entirely propped. Although barrier (1902) is not impermeable, it has sufficient resistance to production fluid permeability to cause production fluid to flow substantially around barrier (1902)

In a further, more specific example, a process is provided for testing the fracture and barrier system for operation, fluid volume, hydraulic enhancement, and remediation. Referring now to Chart-4 an example Test Circulation Capability Around Placed Barrier flowchart is shown to illustrate software for modeling circulation and flow in a designed fluid-conductive fracture, incorporating, for example, the following data: static bottom hole temperature; minimum horizontal stress; formation interval height; formation pressure; and, borehole geometry, as used to design a circulating system in the propped fracture.

Figure 17E:
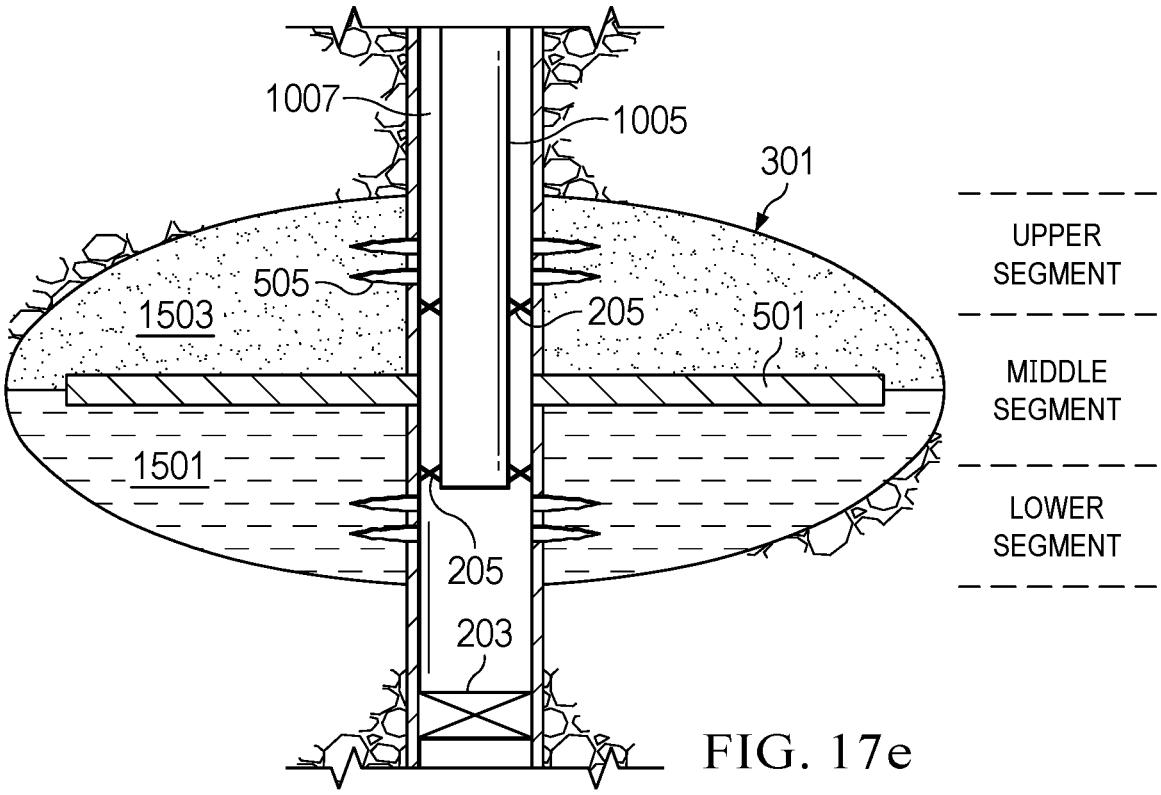
Figure 17F:
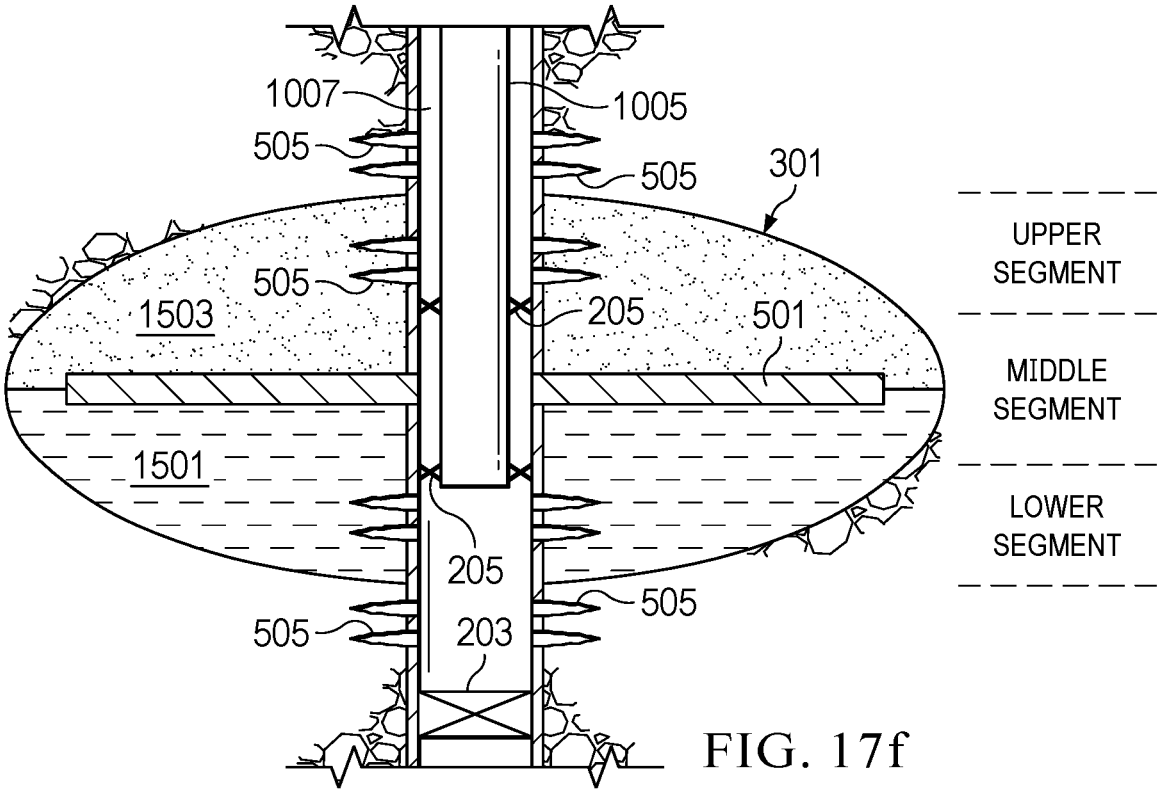

Referring now to FIG. 17*e*, the test is performed by locating bridge plug (203) to below the lowest perforation (505). In at least one example, packers (205) isolate above and below the middle set of perforations (505), and pumping of heat-carrying fluid (e.g., water) occurs through the tubing (1005) and lower perforations (505). The fluid circulates around the barrier (501) and into annulus, returning to the surface. There, measurements that will occur to those of skill in the art are used to determine circulation of heat-carrying fluid, and to determine the acceptability of system rate, back pressure, water loss, solids production, heat production, and workover economics. In at least some other examples, the fluid flow pumping is reversed.

Referring again to FIG. 17*d*, in some cases, remediating or enhancing the hydraulic conductivity and the dimensions of the fracture-reservoir by refracturing is performed by repeating the hydraulic fracturing steps previously described. As a precaution respecting potential damage to the barrier, packers are set above and below the middle perforations. Simultaneous pumping through fracturing tubing and through the annulus will equalize uppermost segment and lowermost segment pressures, thus better stabilizing the barrier's resistance to fracturing stress.

Referring now to 17*f*, adding perforations (505) preferably in proximity to fracture (301), that will hydraulically connect to the first perforations because they share the fracturing pressure source, to locations slightly beyond the upper and lower boundaries of the fracture allows further extension of reservoir dimensions and capacity.

In some applications (e.g., Salton Sea/Imperial Valley), natural hot brine well production may slow quickly after completing a well. In at least one example of the invention, a brine-producing interval is cased off or otherwise sealed, and at least one fluid-conducting stage (examples of which are described above) is installed underneath the sealed off brine producing interval. In still a further example, in areas where there is prolific heat at a shallow level, multiple discrete barriers are installed, creating a maze effect for fluid flow and heat transfer. Discrete barriers are formed by settling as earlier described. During the fracture creation process, the assortment of particle sizes of the proppant settle at differing levels throughout the fracture, which results in corresponding instances of higher and lower hydraulic conductivity, thereby emulating the functions of a full barrier. Extensive perforations are made at the top of the fluid-conductive fracture and fewer are made at the lower portion of the fluid-conductive fracture. Pumping rates and pressures are adjusted according to a predetermined model to optimize circulating fluid height and heat transfer to the fluid being pumped.

Referring again to FIG. 5 and FIG. 14, according to still another aspect of the invention, a geothermal well is provided in high-temperature, impermeable rock (111), the well comprising:

a borehole (109) in a target zone (305) in the high-temperature, impermeable rock (111);

an induced, fluid-conductive fracture (301) at a target zone (305) in the high-temperature rock (111) includes:

a substantially-radial width dimension, and a substantially-radial length dimension, wherein:

the substantially-radial length dimension is greater than the substantially-radial width dimension, the substantially-radial length dimension extends radially from a borehole (109) axis (303) and is longer than the radial width dimension, within the fluid-conductive fracture (301), a fluid-impermeable barrier (501) extends substantially-radially from the borehole (109), capable of diverting fluid under pressure on a first side of the barrier (501) in the target zone (305) to flow away from the borehole (109), around the barrier (501), and into the target zone (305) on a second side of the barrier (501);

a production tubing in the borehole (109), wherein said tubing and borehole (109) define an annulus (207) between said tubing and borehole (109) that is in fluid communication said induced fracture (301);

a substantially impermeable barrier (501) located in said induced fracture (301) and extending to the substantially the entire width and to a portion of the length of said fracture (301); and at least one isolator (e.g., a packer (205)) located in said annulus (207) capable of directing fluid from said annulus (207) into said induced fracture (301) on a first side of said barrier (501) and substantially preventing fluid entering said annulus (207) from said fracture (301) on a second side of said barrier (501) from crossing past said barrier (501) through said annulus (207);

wherein the interior of said tubing is in fluid communication with a said annulus (207) on the second side of said barrier (501).

In some examples of the invention, a traditional packer or another type of isolating element, even if discretely sufficient, is not so when used high temperature. Accordingly, an inventive packer and method of isolating are provided for wells and well hardware that experience highly variable thermally stresses. The following issues are addressed:

Conventional packers grip wellbores or casing surfaces, thereby fixing or restraining one end of the production tubing assembly attached to the packer.

The opposite end of the production tubing assembly is then also fixed by tubing hanger and wellhead hardware.

Thermal and pressure variations are well known to cause stresses of tension, compression, buckling, ballooning, and pistoning (contradictory up/down forces to the inner and outer areas of a packer) stresses. Those stresses cause loss of the packer isolation seal or even tubing string failure.

Figure 20C:
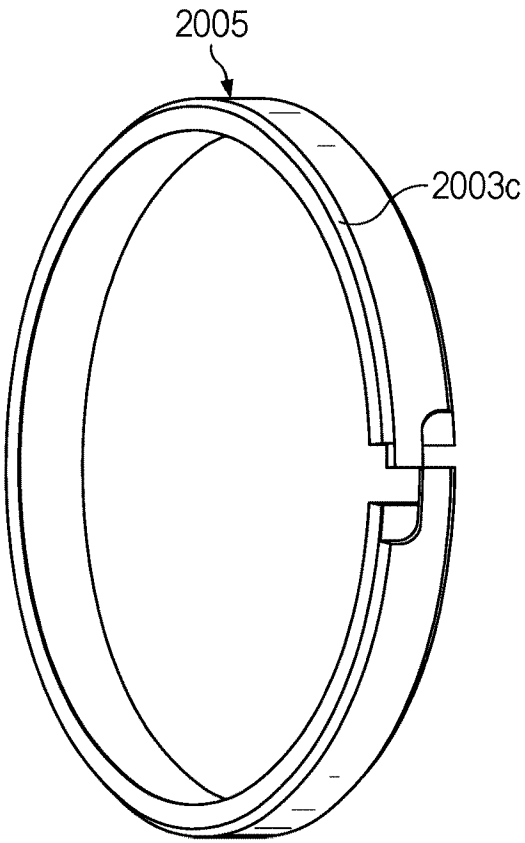
FIGS. 20*a*-20*e* shows examples of the invention in 3D perspective views.
Figure 20B:
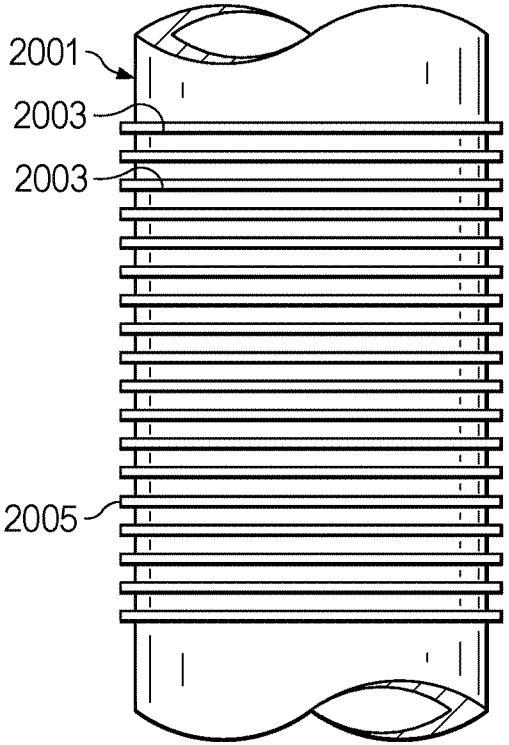
Figure 20A:
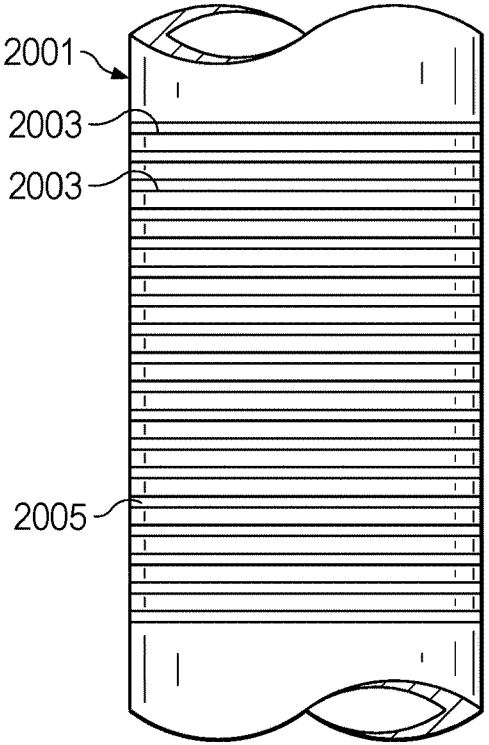

Referring now to FIG. 20*a* and FIG. 20*b*, yet another aspect of the invention is addressed. Specifically, a packer (205) is provided comprising: a hollow cylinder (2001) having recesses (aka, grooves) (2003) positioned axially along the cylinder (2001). Compressible rings (2005) are positioned in the grooves (2003), which are seen compressed in FIG. 20*a* and relaxed in FIG. 20*b*.

Figure 20F:
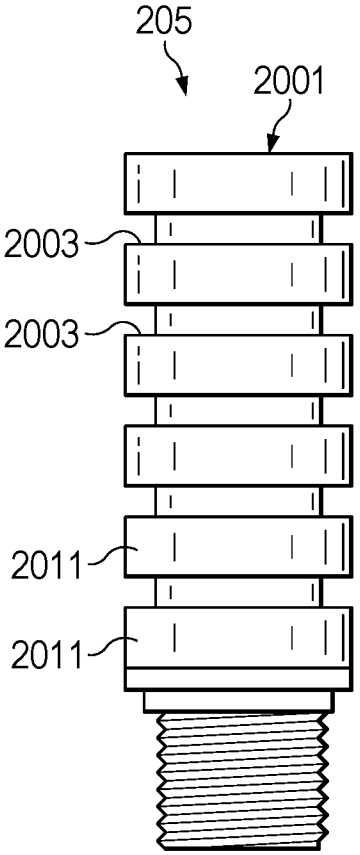
FIG. 20*f* shows an example of the invention in a side view.
Figure 20E:
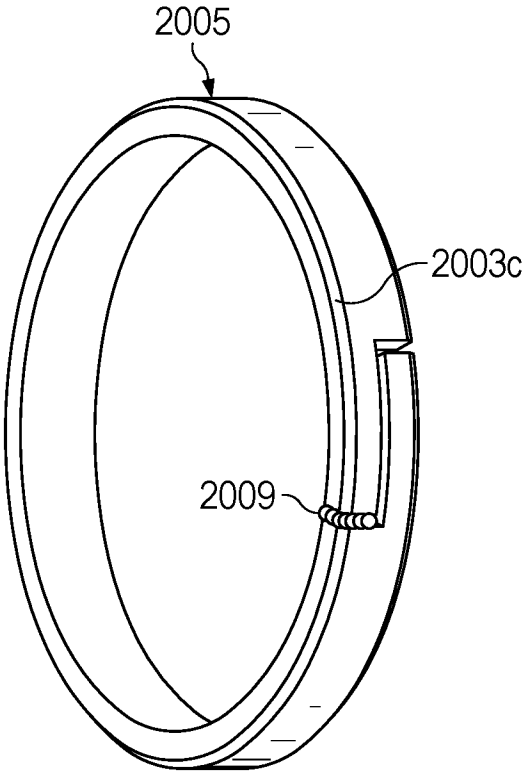
Figure 20D:
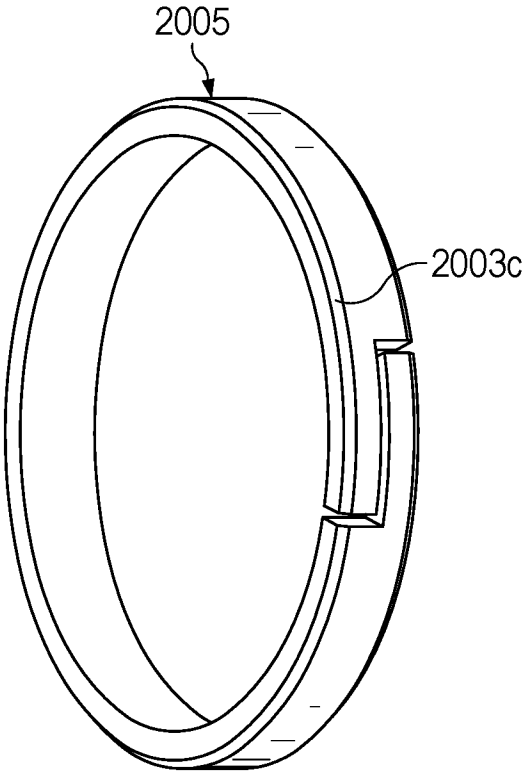

As seen in FIG. 20*c* and FIG. 20*d*, in some examples, rings (2005) comprise spring metal split rings (e.g., steel). In FIG. 20*c*, ring (2005) is a split ring of a stepped and or complementary surface type applied to the ring's split ends, seen in its relaxed state, and FIG. 20*d* shows an alternative ring (2005) in its compressed state. In some examples, the sliding portion of ring (2005) comprise portions of equal length. In still further examples, the rings and or cylinder comprise composites.

The rings are deployed in a borehole with a clearance when held in their compressed state and making a seal with the borehole when expanded out of their compressed state but not to their relaxed position. Rings (2005) have a compression-resistant force sufficient to effectuate seal. In some examples, cylinder (2001) comprises a completion string sub having threaded connections (e.g., a pin and box) adapted for insertion in a completion string. In some examples, cylinder (2001) comprises a sleeve having an axial opening accommodating installation of the cylinder (2001) around a traditional completion mandrel.

As seen in FIG. 20*c*, in some cases, rings (2005) compressible rings (2005) comprise split spring steel rings (2005) having a chamfer (2003*c*) on their outer edges, which improves movement along the borehole (109) by forcing a ring (2005) engaging a projection from the borehole (109) to be compressed slightly, reducing obstructions.

In FIG. 20*e*, an example fastener is seen comprising heat-sensitive fasteners that prevent the expansion of the rings (2005) until a particular heat is reached, releasing said rings (2005). In some examples, the fastener comprises specially-designed solder (2009) that is formulated to melt at specific temperatures; in alternative examples, the fastener comprises a dissolvable material that will go into solution under specific thermal and/or chemical conditions, as will occur to those of skill in the art. Other examples of acceptable fasteners include bands, tack welds, windings, rivets, pins, wires, clasps, temporary one direction ratchet teeth, and Ω shapes.

Referring to FIG. 20*f*, an example is seen in which cylinder (2001) is modular, wherein a set of modules (2011) connected in series, of the packer (205). Grooves (2003) are formed between each successive module (2011) to receive rings (2005). In at least one such example, modules (2011) comprise a threaded pin end and a threaded box end, arranged such that when a pin of one module is fully engaged with the box of another, a gap exists between the outer diameter of the two modules, defining a recess of cylinder (2001) of multiple, connected modules.

As many as 20 (or more) fracture stages may be used in various examples, each requiring a bridge plug (203) and a packer (205). Simultaneous activation of packers (205) is desirable in various aspects of the invention. In some examples, conventional packers may be used that are of the swellable, elastomeric variety if they can be set simultaneously. However, such installations are effectively permanent, requiring major workover operations for retrieval, with tubing damage expected.

In a preferred example, a piston ring packer is provided in place of the conventional packers. In at least one example, the piston ring packer provides a self-adjusting, multi-simultaneous installation with a wider temperature tolerance than swellable, elastomeric packers. Such a packer is useful in at least three applications:

Heat transfer fluid flow diversion

Isolation of barrier area perforations

Frac packer

As mentioned, in some examples, a commercial installation may have 20 or more fracture stages, each requiring one or more packers (205). Therefore, dozens of simultaneous activations and proper functions of each must occur, a condition not possible with conventional mechanical means. For example, commercial swellable elastomer packers are the only alternative to potentially set multiple packers simultaneously, but such installations are slow to activate and are effectively permanent, requiring major workover operations for retrieval, with tubing damage expected. The present piston ring packer is self-adjusting, multi-simultaneous, and has an unlimited temperature scheme anywhere. An alternative is a low annular clearance method, which are known to those of skill in the art. Three applications of the ring-packer disclosed herein include the following.

In at least one example, a metal cylinder (2001) is machined to have transverse or oblique groves (2003) the outer diameter of the cylinder (2001). In at least one example, the groves (2003) are substantially perpendicular to the axis of cylinder (200). In some such examples, a packer for use in a 10.5-inch borehole includes groves (2003) are sized to accommodate rings that will provide flexible bias sufficient for expansion with enough force to create a seal between the borehole and the tubular. In at least one more specific example, rings (2005) have a radial width of 0.720 inches deep and have an axial height of 0.500 inches when using a high yield material (e.g., a 4150 series steel equivalent) with a cylinder having an outer diameter of about ten inches (e.g., made of P110 series steel equivalent). In another example, groves (2003) are separated by approximately the same length as the ring height to accommodate different materials having differing coefficients of thermal expansion. Other spacing ratios will apply in alternative examples that will occur to those of ordinary skill without further elaboration. In some applications (for example, when used as an isolation device in the circulation of fluid in an operating geothermal well), the grooved mounting cylinder (205) is incorporated into its own mandrel, having its own threaded box and pin for connection in a part of a tubing string for deployment (also part of a production tubular). In other examples, the cylinder (205) is split and bolted or pinned to a section of tubing, as will occur to those of skill in the art without further elaboration, allowing placement onto a production tubular). In some examples, the cylinder (2001) is slipped over production tubing and held in place by end-clamps.

In some examples, rings (2005), are designed using the (diametric) elastic beam bending formula: Ring thickness= (Diameter-expanded X Diameter-compressed X Yield Strength)/E(D−exp−Dcomp). Split rings are then formed with the same depth as the cylinder grooves and with an outer diameter (when uncompressed) that is larger than the mounting cylinder OD (11.0 inches in this example) for insertion into the cylinder's grooves, allowing a slip-fit clearance of 0.001 inches to 0.002 inches. In many examples, such rings use thin-member lamination and joining techniques or alternative spring types as spelled out in J.A. Spray self-expanding tubular/leaf spring or helical spring type mechanisms or concepts, U.S. Pat. Nos. 7,677,321, 8,800,650, and 8,978,776 (incorporated herein by reference for all purposes) in order attain greater expansibility or sealing force.

In the various examples, end treatments are applied to the rings, causing sealing continuity. In at least one example, the treatment includes tapering the ring ends in a manner that the axial surfaces are complementary when overlapped, and when later diametrically compressed, the height of the ring will not exceed the receiving groove height and clearance. The length of the tapers is preferably sufficient to effect continuity of expanded ring circumference. In various examples, the configuration of the split of the ring comprises, in the alternative, male-to-female, end-to-end, and others vary as will occur to those of skill in the art) and still provide sufficient sealing, depending on the application of the packer.

In some examples, the rings (2005) are inserted into the cylinder's grooves (2003) by first temporarily forcibly opening to >10.00 inches ID, but staying within the ring's elastic region, then letting the ring recover to its natural dimensions, now located partially inside the groove. In preparation for deployment, the rings (2005) are compressed radially until their OD is flush with or preferably recessed slightly from the outer diameter of the cylinder (2001), thus protecting the outer sealing surfaces or elements during placement into the well. Rings (2005) are then secured with welded, pinned, or other mechanisms that are activated from dissolvable material or with solder having a liquid state upon heating that is tuned to release the elastically self-adjusting rings according to corresponding downhole temperature. In various applications, an external heating source (e.g., electrical, chemical, or other types) is applied through production tubing via coil tubing or wireline to accelerate release or to allow higher temperature for release (and thus more controllable, safer handling).

Even in applications in which there are significant wellbore irregularities, interference and tight manufacturing tolerances (down to 0.001 inches or less) cause high friction-pressure losses as viscous fracturing fluids attempt to flow through, thereby effectively creating a seal that is sufficient for the creation of fractures and isolations contemplated in this document. In practice, a complete seal is not necessary. Further, multiple rings are used in various examples of the packer that sufficient sealing is achieved by the sum of the individual rings.

In some specific examples, in which the packer is used as an isolating element in fracturing operations, fracture fluid surface tension (which is the force holding the fluid together) will measure approximately 1000 dyne per centimeter, compared with 32 for freshwater. With the example device dimensions, supplied as a 40 feet long isolation tool would provide 20 feet of intermittent seal surface at the well face. Further, applying a rounded chamfer/radius about the spring edges facilitates all movement of the rings during compression, actuation, service, and any recompression.

As a long-term operational matter, should scaling deposits or debris cause the packer to become immobile, pulling or pushing the tubing, or application of force in any direction will cause the chamfer to compress the ring, triangular force at the radius, thus recompressing the ring, reducing the packer's diameter, and assisting with freeing the device.

Alternatively, dissolvable materials may be applied to the spring surface that engages with the formation, so as to further reduce the outer diameter of the spring's expanded state.

According to still another aspect of the invention, a process is provided for creating a seal in an annulus (207) between a cylinder (2001) and a borehole (109) located in a target zone (305) in high-temperature, impermeable rock (111), the process comprising: extending to the high-temperature, impermeable rock (111), rings (2005) from recesses in the cylinder (2001), applying a force sufficient to substantially redirect fluid from the annulus (207) into a fluid-conductive fracture (301) at a target zone (305) in the high-temperature, impermeable rock (111). In at least one example, the extending comprises releasing retainers applied to the rings (2005) to prevent the rings (2005) from expanding. In a further example, the applying comprises constraining by the borehole (109) preventing the rings (2005) from expanding to a relaxed, extended state.

In an alternative embodiment packer device, sealing is effected by use of long continuous length low annular clearance between the isolation device and well ID, but without the need for mechanically interfering details.

The enlarging of sections of the production tubing to an outer diameter of slightly less than well ID (or adding components to the tubing assembly to produce the same effect) effectively produces a micro-volume that causes high friction losses as fluids pass through it. The sealing effect is similar to sealing created by micro fractures, described earlier.

Radial low clearances are defined by small multiples of 0.5% of the drift diameter (the smallest guaranteed inner diameter) in a cased hole. An example radial packer clearance through a 10.00 inch inner diameter is 10−(10×0.995) =0.050 inches.

The propped fracture stages are intended for 500 feet vertical separation, thereby capable of accommodating approximately 450 feet of low clearance isolation. The invention is intended to circulate in excess of 1000 gallons per minute of heat carrying fluids. By obtaining simple order pressure loss calculation by use of annular pressure calculators reveals a 778-psi loss when merely 10 GPM passes through the micro-volume.

Because the expected pressure losses when flowing heat carrying fluid through a propped fracture and barrier system are expected as negligible, the novel packer approach clearly will serve to divert the vast majority of fluids through the fractures, rather than through the low clearance annulus arrangement.

In a further alternative, annular clearances is increased and sealing effectiveness enhanced by the addition of flexible fins, partial cups, scoops, etc. placed about the device OD to disrupt flow, with such details released upon reaching specified temperature as earlier described.

In at least some examples, the following components discussed previously are described as follows:

Alkali aluminosilicates—Generally three polymerized glasses with varying ratios of Na/K [(22.5-x)$Na_2O$-xK2O-22.5 Al2O3-55 SiO2 with x=0, 7.5, and 11.25].

Fly ash—Fine gray powder consisting mostly of spherical, glassy particles that are produced as a byproduct in coal-fired power stations.

Coked hydrocarbon—A final carbon-rich solid material that derives from oil refining and is one type of the group of fuels referred to as cokes. Also, a hard, strong, porous material of high carbon content.

Cement-fly ash—Fly ash in cement is widely used across the U.S. to the strength of concrete.

Cement lime—Lime in cement has better withstanding aging properties than straight concrete.

Cement-calcium hydroxide—Calcium hydroxide is one of the main reaction products resulting from the hydration of Portland cement with water. Hydrocarbon coating calcium chlorite with it accelerates its setting time.

Bentonites—Naturally occurring materials that are composed predominantly of the clay mineral smectite, formed by the alteration of volcanic ash in marine environments.

Internal Setting Catalysts—Chemicals that allow controlled setting of a specific alkali aluminosilicate at high temperatures.

Oil-based muds—A typical oil-based mud (natural or synthetic) consists of the base oil, brine, lime, an emulsifier, a wetting agent, a viscosifier, and a filtration control additive. Its properties are enhanced by adding oil dispersible clays.

What is claimed is:

1. A process of creating a geothermal well in high-temperature, impermeable rock, the process comprising:

sinking a borehole with a generally-vertical trajectory into the high-temperature, impermeable rock;

creating a fluid-conductive fracture in the formation, substantially-laterally from an axis of the borehole, at a target zone in a geologic formation of interest for geothermal energy production, wherein said creating causes the fluid-conductive fracture to have a substantially-vertical dimension that is larger than a substantially-horizontal width dimension and a substantially horizontal length dimension extending substantially-radially from the axis, wherein the substantially-horizontal length dimension is longer than the horizontal width dimension;

installing a flow-resistant, thermally-insulated barrier substantially laterally from the borehole, wherein the barrier is positioned to divert fluid under pressure on a first side of the barrier in the target zone to flow away from the borehole, around the barrier, and into the target zone on a second side of the barrier; and forcing through the borehole, from a surface location, fluid under pressure on the first side of the barrier in the target zone to flow away from the borehole, around the barrier, and into the target zone on the second side of the barrier toward the borehole; and retrieving fluid solely from the second side of the barrier to the borehole.

2. A process as in claim 1 wherein said installing a flow-resistant barrier comprises installing a substantially impermeable fluid barrier.

3. A process as in claim 1, wherein said sinking a borehole comprises casing the borehole at the target zone of interest and perforating the casing to access the geologic formation of interest.

4. A process as in claim 1, wherein said creating a fluid-conductive fracture comprises fracturing the high-temperature, impermeable rock in the target zone.

5. A process as in claim 4, wherein the fracturing process comprises:

isolating the target zone from areas of the high-temperature, impermeable rock that are not desired to be fractured such that pressure may be applied to the target zone with a fracture fluid, wherein an isolated target zone is defined;

preparing a low-viscosity, high-temperature, stable, thixotropic fracturing-fluid;

increasing the pressure at the isolated target zone, in excess of a known minimum horizontal formation stress of the target zone, with the low-viscosity, high-temperature, stable, thixotropic fracturing-fluid;

pumping with a calculated volume of a PAD;

following the PAD pumping, adding propant into the PAD as the PAD is pumped;

ramping up propant concentration during the pumping; and ceasing pumping upon obtaining a pre-determined maximum surface pressure.

6. A process as in claim 5, wherein said isolating is performed with a split-ring and grooved cylinder packer.

7. A process as in claim 5, wherein said isolating is performed with a low annular clearance packer.

8. A process as in claim 1, wherein said installing comprises pumping, into the fluid conductive fracture, a propped sealant to a point where a predetermined model predicts the propped sealant has substantially filled the horizontal width dimension and penetrated to a pre-determined portion of the horizontal length dimension.

9. A process as in claim 1, wherein said installing a flow resistant barrier occurs after said creating a fluid-conductive fracture in the formation.

10. A process as in claim 1, wherein said installing a flow resistant barrier is at an interface between liquid and vapor in the fluid-conductive fracture.

11. A process as m in claim 1 wherein said installing a flow resistant barrier comprises installing the barrier at the bottom of the fluid-conductive fracture.

12. A process as in claim 1, wherein said installing a flow resistant barrier comprises installing the barrier outside the fluid-conductive fracture, wherein a layer of high-temperature, impermeable rock resides between the fluid-conductive fracture and the barrier.

13. A process as in claim 1, wherein said installing a flow resistant barrier occurs before said creating a fluid-conductive fracture in the formation.

14. A process as in claim 13, wherein said installing comprises:

isolating a barrier location in the target area, and creating a short barrier fracture in the formation having the dimensions of a desired barrier and being shorter than a desired fluid-conductive fracture; and pumping a barrier material into the barrier fracture.

15. A process as in claim 14, wherein said creating a fluid-conductive fracture in the formation comprises:

creating a first fluid-conductive fracture in the formation above the barrier, creating a second fluid-conductive fracture in the formation below the barrier, establishing a fluid communication connecting the first fluid-conductive fracture and the second fluid-conductive fracture by continuing to enlarge the second fluid-conductive fracture beyond the ends of the barrier until the second fluid-conductive fracture in the formation rises around the barrier to connect with the first fluid-conductive fracture in the formation.

16. A process of operating a geothermal well in high-temperature, impermeable rock having:

a borehole with a generally-vertical trajectory in the high-temperature, impermeable rock, a fluid-conductive fracture at a target zone in a geologic formation of interest for geothermal energy production, the fluid-conductive fracture extending laterally from an axis of the borehole, wherein:

the fluid-conductive fracture has:

a substantially-vertical dimension, a substantially-horizontal width dimension, and a substantially-horizontal length dimension, the substantially-vertical dimension is greater than the substantially-horizontal width dimension the substantially-horizontal length dimension extends radially from a borehole axis and is longer than the horizontal width dimension, within the fluid-conductive fracture, a fluid-impermeable barrier extends substantially-radially from the borehole, capable of diverting fluid under pressure on a first side of the barrier in the target zone to flow away from the borehole, around the barrier, and into the target zone on a second side of the barrier, the process comprising:

forcing through the borehole fluid under pressure on a first side of the barrier in the target zone to flow away from the borehole, around the barrier, and into the target zone on a second side of the barrier toward the borehole; and retrieving fluid solely from the second side of the barrier to the borehole.

17. A geothermal well in high-temperature, impermeable rock, the well comprising:

a borehole in a target zone in the high-temperature, impermeable rock;

an induced, fluid-conductive fracture at the target zone in the high-temperature rock includes said induced, fluid-conductive fracture has:

a substantially-vertical dimension, a substantially-horizontal width dimension, and a substantially-horizontal length dimension, the substantially-vertical dimension is greater than the substantially-horizontal width dimension the substantially-horizontal length dimension extends radially from a borehole axis and is longer than the horizontal width dimension, within the fluid-conductive fracture, a fluid-impermeable barrier extends substantially-radially from the borehole, capable of diverting fluid under pressure on a first side of the barrier in the target zone to flow away from the borehole, around the barrier, and into the target zone on a second side of the barrier toward the borehole, a tubing in the borehole, wherein said tubing and said borehole define an annulus between said tubing and said borehole that is in fluid communication said induced fracture;

a substantially impermeable barrier located in said induced fracture and extending to the substantially the entire width and to a portion of the length of said fracture;

at least one isolator located in said annulus capable of directing fluid from said annulus into said induced fracture on a first side of said barrier and substantially preventing fluid entering said annulus from said fracture on a second side of said barrier from crossing past said barrier through said annulus;

wherein the interior of said tubing is in fluid communication solely with said annulus on the second side of said barrier and is configured to retrieve fluid solely from the second side of said barrier.

* * * * *